US009173536B2

(12) United States Patent
Van Der Kooi et al.

(10) Patent No.: US 9,173,536 B2
(45) Date of Patent: Nov. 3, 2015

(54) CLEANING DEVICE FOR CLEANING A SURFACE COMPRISING A BRUSH AND A SQUEEGEE ELEMENT

(75) Inventors: Johannes Tseard Van Der Kooi, Hurdegaryp (NL); Britt Roumen, Groningen (NL); Pieter Kingma, Drachten (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/237,370

(22) PCT Filed: Aug. 2, 2012

(86) PCT No.: PCT/IB2012/053954

§ 371 (c)(1),
(2), (4) Date: Feb. 6, 2014

(87) PCT Pub. No.: WO2013/027140

PCT Pub. Date: Feb. 28, 2013

(65) Prior Publication Data

US 2014/0189978 A1 Jul. 10, 2014

Related U.S. Application Data

(60) Provisional application No. 61/539,518, filed on Sep. 27, 2011, provisional application No. 61/526,316, filed on Aug. 23, 2011.

(51) Int. Cl.
*A47L 9/04* (2006.01)
*A47L 11/40* (2006.01)

(52) U.S. Cl.
CPC ..... *A47L 9/0488* (2013.01); *A47L 9/0477* (2013.01); *A47L 11/4041* (2013.01); *A47L 11/4044* (2013.01)

(58) Field of Classification Search
CPC . A47L 9/0488; A47L 9/0477; A47L 11/4041; A47L 11/4044
USPC ..... 15/364, 415.1, 320
See application file for complete search history.

(56) References Cited

U.S. PATENT DOCUMENTS
1,694,937 A 12/1928 Floeter
3,699,607 A * 10/1972 Putt ..... 15/320

(Continued)

FOREIGN PATENT DOCUMENTS
DE 102006028035 A1 12/2007
EP 0186005 A1 7/1986

(Continued)

*Primary Examiner* — Dung Van Nguyen

(57) ABSTRACT

The present invention relates to a cleaning device for cleaning a surface (20), comprising: —a brush (12) rotatable about a brush axis (14), said brush (12) being provided with flexible brush elements (16) that are substantially uniformly distributed over the periphery of the brush (12), wherein the brush (12) is at least partly surrounded by a nozzle housing (28) and protrudes at least partially from a bottom side (30) of said nozzle housing (28), which, during use of the device (100), faces the surface to be cleaned (20), wherein the brush elements (16), during the rotation of the brush (12), substantially form a sealing with the housing (28) at a first position (33) where the brush elements (16) leave the housing (28) during the rotation of the brush (12), and contact the surface to be cleaned (20) during the rotation of the brush (12) at a second position (35) for picking up dirt particles (22) and liquid (24) from said surface (20), thereby defining a suction area (34) in a space between the brush (12), said housing (28) and said surface to be cleaned (20) which is at least partly sealed at said first and second positions (33, 35), —a single squeegee element (32) which is spaced apart from the brush (12) and attached to the bottom side (30) of the nozzle housing (28) on a side of the brush (12), where the brush elements (16) enter the housing (28) during the rotation of the brush (12), wherein said squeegee element (32) is adapted for pushing or wiping dirt particles and liquid across or off the surface to be cleaned (20) during movement of the cleaning device (100), thereby defining a suction inlet (36) between the squeegee element (32) and the brush (12)that opens into the suction area (34), —a drive means for driving the brush (12) in rotation, and —a vacuum aggregate (38)which is arranged at a suction outlet (47)of the suction area (34) for generating an under-pressure in said suction area (34) for ingesting dirt particles (22) and liquid (24) from the suction inlet (36).

21 Claims, 8 Drawing Sheets

(56) References Cited

U.S. PATENT DOCUMENTS

| | | | | |
|---|---|---|---|---|
| 3,871,051 | A * | 3/1975 | Collier | 15/321 |
| 4,864,682 | A | 9/1989 | Bewley, Jr. et al. | |
| RE33,926 | E * | 5/1992 | Waldhauser | 15/320 |
| 5,319,828 | A * | 6/1994 | Waldhauser et al. | 15/320 |
| 7,665,172 | B1 | 2/2010 | Tran et al. | |
| 2005/0055785 | A1 | 3/2005 | Spooner | |

FOREIGN PATENT DOCUMENTS

| | | | |
|---|---|---|---|
| EP | 0576174 | A1 | 12/1993 |
| EP | 2064979 | A1 | 6/2009 |
| WO | 2010041184 | A1 | 4/2010 |

* cited by examiner (state of the art)

(state of the art)

(state of the art)

(state of the art)

CLEANING DEVICE FOR CLEANING A SURFACE COMPRISING A BRUSH AND A SQUEEGEE ELEMENT

CROSS-REFERENCE TO PRIOR APPLICATIONS

This application is the U.S. National Phase application under 35 U.S.C. §371 of International Application No. PCT/IB32012/053954, filed on Aug. 2, 2012 which claims the benefit of U.S. Provisional Patent Application No. 61/539518, filed Sep. 27, 2011 and U.S. Provisional Patent Application No.61/526316, filed Aug. 23, 2011. These applications are hereby incorporated by reference herein.

FIELD OF THE INVENTION

The present invention relates to a cleaning device for cleaning a surface. Further, the present invention relates to a nozzle arrangement for such a cleaning device.

BACKGROUND OF THE INVENTION

Hard floor cleaning these days is done by first vacuuming the floor, followed by mopping it. Vacuuming removes the coarse dirt, while mopping removes the stains. From the state of the art many appliances, especially targeting the professional cleaning sector, are known that claim to vacuum and mop in one go. Appliances for the professional cleaning sector are usually specialized for big areas and perfectly flat floors. They rely on hard brushes and suction power to get water and dirt from the floor. Appliances for home use often use a combination of a hard brush and a squeegee nozzle. Like the appliances for the professional cleaning sector these products use the brush to remove stains from the floor and the squeegee in combination with an under-pressure to lift the dirt from the floor.

Said squeegee elements are usually realized by a flexible rubber lip that is attached to the bottom of the cleaning device and merely glides over the surface to be cleaned thereby pushing or wiping dirt particles and liquid across or off the surface to be cleaned. An under-pressure, usually generated by a vacuum aggregate, is used to ingest the collected dirt particles and liquid.

A squeegee device for a vacuum cleaner system is, for example, known from EP 0 576 174 A1. A sweeper that uses an above-mentioned combination of a brush and a squeegee is, for example, known from U.S. Pat. No. 7,665,172 B1. The power floor sweeper described therein comprises a foot assembly with a motor driven primary agitator and a pair of edge agitators coupled to wheels such that manual propulsion of the sweeper rotates the wheels and thereby the edge agitators. The sweeper, however, does not include a vacuum source and is therefore not able to pick-up water from the floor to be cleaned. The performance on drying the floor is thus rather low.

Another vacuum cleaner that is known from the prior art and also uses a combination of a rotating brush and a squeegee is known from U.S. Pat. No. 4,864,682 A. This vacuum cleaner comprises a self-adjusting wiper strip assembly that automatically adjusts for the type of floor surface on which the vacuum cleaner is being used. The assembly used therein requires a high suction power in order to receive a satisfactory cleaning result. The brush which is used in this vacuum cleaner is an agitator (also denoted as adjutator) with stiff brush hairs to agitate the floor, e.g. a carpet. These stiff hairs show a rather good scrubbing effect, which enable to use the brush particularly for removing stains. However, the performance on drying the floor is rather low, since such an agitator is not able to lift liquid from the floor.

Vacuum and mop in one go devices known from the prior art often use brush elements that are actively sprayed with water or a cleaning rinse in order to improve the removal of stains. Such devices usually use a double squeegee element having two squeegees that are arranged on one side of the brush, as this is exemplarily shown in the attached FIG. 12. An additional vacuum source generates a suction in a channel between said double squeegee arrangement in order to remove the cleaning water from the floor again.

However, in order to remove the actively sprayed cleaning water from the floor again these devices always have to be moved in a forward direction in which the brush is, seen in the direction of the device movement, located in front of the double squeegee arrangement. Moving the device in an opposite backward direction would leave the floor wet, since the cleaning water which is dispersed with the brush is not removed from the squeegees in this backward stroke.

To get a good cleaning result in a forward as well as in a backward stroke of the device known cleaning devices are therefore provided with a double squeegee nozzle on both sides of the brush. Such an arrangement is exemplarily shown in the attached FIG. 13. Even though such double squeegee arrangements on both sides of the brush show good cleaning results, the nozzle of these devices become fairly bulky. This again results in a non-satisfying, limited work capability. Especially in household appliances where often narrow corners need to be cleaned, such bulky nozzles are, due to their limited liberty of action, uncomfortable to use.

Besides that, the use of double squeegee arrangements as shown in the attached FIGS. 12 and 13 has several further disadvantages. Due to the constant contact of the squeegees with the floor during the movement of the device, such double squeegees may generate a high scratch load to the floor. Especially when the double squeegee arrangements are used on each side of the brush (see FIG. 13), this will lead to an increased risk of inducing scratches on the floor. Furthermore, such squeegee arrangements include the disadvantage that they are not open for coarse dirt like e.g. hairs or peanuts, since coarse dirt is often entangled within the squeegees or pushed away from the squeegees, and is thus not able to enter the suction inlet. This situation is shown in the attached FIG. 15 in a schematic way. Therein, reference numerals 90 and 90' denote the two squeegees. If, during the movement of the vacuum cleaner, the squeegee 90' approaches a coarse dirt particle 92, this particle will be entangled in front of the squeegee 90' and will not be able to enter a suction area that is defined in the space between the two squeegees 90, 90', since the squeegees are in constant contact with the floor. Apart from that, such double squeegee nozzles are hard to clean and do not have the ability to clean themselves.

In order to overcome these disadvantages other devices known in the art use two separate brushes that are arranged in parallel to each other (schematically shown in attached FIG. 14). A cleaning device of this kind is exemplarily known from U.S. Pat. No. 1,694,937. Said document discloses a floor scrubbing machine, which is capable of picking up dirt from a floor by two cylindrical floor brushes disposed parallel and close together. These brushes rotate at high speeds, one running clockwise and the other one counterclockwise. In this way, the adjacent peripheries travelling together with a sufficiently high velocity to project the dirt vertically upwards with a considerable force in the form of a substantially flat jet. A wiper or a squeegee is applied in addition to the brushes in order to dry the floor. Due to the two separate brushes and the additional squeegees the nozzle becomes also according to this solution fairly bulky, which again ends up in a non-satisfying liberty of action for the consumer.

SUMMARY OF THE INVENTION

It is an object of the present invention to provide an improved cleaning device that shows, compared to the state of the art, an improved cleaning performance, and overcomes the above-mentioned disadvantages.

This object is achieved by a cleaning device for cleaning a surface that comprises:

- a brush rotatable about a brush axis, said brush being provided with flexible brush elements that are substantially uniformly distributed over the periphery of the brush, wherein the brush is at least partly surrounded by a nozzle housing and protrudes at least partially from a bottom side of said nozzle housing, which, during use of the device, faces the surface to be cleaned, wherein the brush elements, during the rotation of the brush, substantially form a sealing with the housing at a first position where the brush elements leave the housing during the rotation of the brush, and contact the surface to be cleaned during the rotation of the brush at a second position for picking up dirt particles and liquid from said surface, thereby defining a suction area in a space between the brush, said housing and said surface to be cleaned, which is at least partly sealed at said first and second positions,
- a single squeegee element which is spaced apart from the brush and attached to the bottom side of the nozzle housing on a side of the brush, where the brush elements enter the housing during the rotation of the brush, wherein said squeegee element is adapted for pushing or wiping dirt particles and liquid across or off the surface to be cleaned during movement of the cleaning device, thereby defining a suction inlet between the squeegee element and the brush that opens into the suction area,
- a drive means for driving the brush in rotation, and
- a vacuum aggregate which is arranged at a suction outlet of the suction area for generating an under-pressure in said suction area for ingesting dirt particles and liquid from the suction inlet.

The above-mentioned object is furthermore, according to a second aspect of the present invention, achieved by a corresponding nozzle arrangement for use in a cleaning device as mentioned before.

Preferred embodiments of the invention are defined in the dependent claims. It shall be understood that the claimed nozzle arrangement has similar and/or identical preferred embodiments as the claimed cleaning device and as defined in the dependent claims.

The present invention is based on the idea, that instead of using a double squeegee nozzle as this is done in many appliances known from the art, the properties and the arrangement of the brush are chosen such that the brush has the functionality of a squeegee, without obstructing coarse dirt to enter the nozzle. Having the functionality of a squeegee means that the brush is, besides being able to pick-up dirt, also able to pick-up liquid from a surface. This is realized by providing a so-called "sealing brush", as the inventors have named this special type of brush. Such a sealing brush is so far not known in the art. The name "sealing brush" comes from the special sealing properties that occur during the use of such kind of brush.

The sealing properties of the brush rely on the fact that a brush is used, which is provided with flexible brush elements that are substantially uniformly distributed over the periphery of the brush. In other words, a uniform distribution of the brush elements is provided over the periphery of the brush. The arrangement of the brush within the nozzle housing is chosen, such that the brush elements, during the rotation of the brush, substantially form a sealing with the housing at a first position where the brush elements leave the housing during the brush's rotation. Additionally, an at least partly sealed area is formed at a second position where the brush elements, during the rotation of the brush, contact the surface to be cleaned. In this way, a suction area is defined in the space between the brush, the nozzle housing and the surface to be cleaned, which suction area is at least partly sealed to the surrounding of the nozzle. "Sealing" or "sealed" in the context of the present invention does not mean a complete sealing to the surrounding, since otherwise dirt and liquid could not be picked up from the surface any more. "Sealing" or "sealed" in the context of the present invention rather refers to a situation in which an air leakage at the above-mentioned two positions is reduced to a minimum, or in other words, in which only a relative constant small amount of air is able to pass the area in between the housing and the brush at said first position and in between the brush and the surface at said second position. In this way, a kind of restriction is created preventing an unwanted, too high air leakage at the described two positions. The most part of the air is guided in the space that occurs between the brush elements. This amount of air mainly depends on the space between the brush elements and the rotational speed with which the brush is driven to rotation. The space again depends on the density of the brush elements.

The sealing at said first position may, for example, be realized by arranging the nozzle housing or a part of it so close to the brush in the area where the brush elements leave the housing, wherein a thin channel is formed between the housing and the brush in this area. In other words, the nozzle housing is in this area preferably arranged so close to the housing that the brush almost touches the housing. A distance of approximately 0.5 mm between the housing and the brush has shown good sealing results. Also larger distances are conceivable. However, in this case the above-mentioned thin channel between the housing and the brush needs to be longer in order to realize the above-mentioned restriction effect. "Longer" in this sense means that the extension of the thin channel in the peripheral direction of the brush needs to be larger. It is to be noted that a contact between the brush and the housing is also possible without leaving the scope of the invention.

In order to reach an above-mentioned kind of sealing, the brush needs to be provided with very thin fiber hairs that are uniformly distributed over the periphery of the brush. These thin fiber hairs are referred to as brush elements. By driving the brush in rotation, as this according to the invention done with a drive means, the flexible brush elements, due to the occurring centrifugal accelerations, are straightened out, become stiff, and thereby form a kind of "wall". This "wall" can be imagined as an almost uniform cylinder. Thus, the driven brush elements, in the figurative sense, behave like a forest with many trees where the trees impede the wind flow. Said cylinder is, however, not completely closed. Very thin spaces occur between the thin fiber hairs of the brush in which dirt particles and liquid droplets may be transported. This transport of the dirt and liquid particles mainly relies on adhesive and/or capillary forces that occur in said spaces in between of the brush elements. This adhesive and/or capillary effect is especially distinctive if the brush elements have a small material density. Since the brush elements are realized as thin micro fiber hairs that use to be flexible, the so-called "wall-effect" as well as the "sealing-effect" of the fibers just occur during the rotation of the brush, whereas the brush-elements more or less dangle if the brush is not rotated.

In this way, the brush is able to pick-up liquid from the floor when the brush elements contact the floor during the rotation of the brush. Due to the thin microfiber hairs the brush is also open for coarse dirt.

During the brush rotation, the brush elements contact the floor with their tip portions and pick-up the dirt particles and the liquid from the floor during a pick-up period in which said tip portions contact the floor. When the brush elements come into contact with a dirt particle or liquid at the above-mentioned second position, the brush elements may be bent. As soon as the brush elements with the dirt particles and liquid adhering thereto loose contact with the surface, the brush elements are straightened out, wherein especially the tip portions of the brush elements are moved with a relatively high acceleration. As a result the centrifugal acceleration at the tip portions of the brush elements is increased. Hence, in a dirt release period, in which the brush elements are inside a nozzle housing and free from contact to the surface, the centrifugal acceleration of the tip portions of the brush elements becomes so high that the occurring centrifugal forces that appear to the dirt and liquid particles within the micro fiber hairs become stronger than the adhesive forces with which the dirt and liquid particles are repressed from the brush elements. The dirt and liquid particles are thus automatically released in the dirt release period. Since not all dirt particles and liquid droplets may be directly ingested by the vacuum aggregate, a small amount of dirt and liquid will be flung back onto the surface in the area where the brush elements loose the contact from the surface. However, this effect of re-spraying the surface is overcome by the squeegee element which collects this re-sprayed liquid and dirt by acting as kind of wiper, so that remaining liquid and dirt may then be ingested due to the applied under-pressure. The squeegee therefore ensures that the remaining liquid and dirt is not leaving the suction area again without being ingested by the vacuum aggregate. It therefore kind of closes the suction area for dirt and liquid on one side of the nozzle housing.

Besides the centrifugal forces as mentioned, other acceleration forces can be present, particularly acceleration forces which are due to deformation of the flexible brush elements. Such deformations may exemplarily occur when the flexible brush elements contact the floor during rotation or encounter liquid or dirt particles.

The chosen nozzle arrangement further comprises a single squeegee element which is spaced apart from the brush and attached to the bottom side of the nozzle housing on a side of the brush, where the brush elements enter the housing during the brush's rotation. Said squeegee element is adapted for pushing or wiping dirt particles and liquid across or off the surface to be cleaned during movement of the cleaning device. It acts as a kind of wiper that wipes the surface and thereby collects liquid droplets and dirt particles from the surface to be cleaned. A suction inlet is defined between the squeegee element and the brush that opens into the suction area.

By means of a vacuum aggregate that is arranged at a suction outlet, an under-pressure is generated within said suction area. Thus, the dirt and liquid particles which have been collected by either the squeegee element or the brush are ingested into the suction area towards the suction outlet.

Due to the sealing properties of the brush that have been described above, a suction channel is formed between the squeegee and the brush. Since the air leakage is, due to said sealing properties, reduced to a minimum, the generation of the under-pressure within the suction channel (also called suction area) can be achieved with a minimum amount of power. This enables to use smaller vacuum aggregates in order to establish the same or even higher under-pressures. Compared to state of the art devices, thus higher under-pressures can be achieved with smaller vacuum aggregates. This saves power consumption, which again result in a major cost advantage for the user. Apart from that, this may also result in a reduction of the weight and size of the vacuum aggregate, which again improves the user-friendliness of the device.

A further advantage of the sealing brush is that, due to the achieved under-pressure within the suction area, the squeegee element and the brush are constantly cleaned. Compared to double squeegee solutions as explained in the introduction, the suction area is defined by one rigid wall (realized by the squeegee) and one moving wall which is realized by the brush, instead of two rigid walls that are realized by two squeegees. Especially in cases in which the brush is actively sprayed with water the sprayed water automatically cleans the brush and the squeegee which is arranged on the opposite side of the brush in the suction area. In other words, this results in a kind of self-cleaning of the brush and the squeegee. In contrast to brushes using double squeegee solutions this extremely simplifies the cleaning of the device.

In contrast to brushes used according to the prior art, which are only used for stain removal, a soft brush with flexible brush elements as presented here also has the ability to pick up liquid from the floor. Thus, a second squeegee element is no longer needed. The sealing brush itself acts as a kind of squeegee, since it is able to pick-up liquid and at the same time reduces the air leakage from the suction area to the surroundings. Compared to a squeegee the sealing brush has furthermore the advantage that it is open for coarse dirt.

By reducing the number of squeegees to only a single squeegee element, not only the size of the housing can be reduced, making the nozzle less bulky, but also scratching of the floor, which might be caused by the squeegees, can be significantly reduced. Besides that, a single squeegee element is much easier to clean.

Concerning the arrangement, the following has to be further noted: The brush is preferably arranged at one side of the housing of the nozzle, whereas the squeegee element is arranged on another side of the housing, parallel to the brush, so that the brush and the squeegee element appear to be behind each other, when seen in an intended direction of the movement of the device. The squeegee and the brush are thereto arranged on a bottom-side of the nozzle housing, which during use of the device faces the surface to be cleaned. The squeegee and the brush at least partly protrude from the nozzle housing on this bottom side. When moving the device, the squeegee element glides over the surface to be cleaned and thereby pushes or wipes dirt particles and liquid across or off the floor, while the brush, during its rotation, at same time picks-up dirt and liquid particles from the surface. In this way a suction inlet is created in between the brush and the squeegee element, which during use of the cleaning device, faces the surface to be cleaned. This suction inlet opens into the suction area, in which the above-mentioned under-pressure is created.

According to a preferred embodiment of the present invention, the under-pressure generated by the vacuum aggregate is in a range of 3 to 70 mbar, more preferably in a range of 4 to 50 mbar, most preferably in a range of 5 to 30 mbar. State of the art vacuum cleaners need to apply higher under-pressures in order to receive acceptable cleaning results. However, due to the above mentioned properties of the brush, very good cleaning results may already be realized in the above-mentioned pressure ranges. Thus, also smaller vacuum aggregates may be used. This increases the freedom in the selection of the vacuum pump.

According to a further preferred embodiment of the present invention, the nozzle housing and the squeegee element extend along a longitudinal direction that is parallel to the brush axis and transverse, preferably perpendicular to the intended direction of movement of the cleaning device. During the movement of the device the brush and the squeegee are therefore able to encounter dirt and liquid particles along their complete longitudinal sides. By arranging the brush axis and the squeegee element parallel to each other, a perfect collaboration of the brush and the squeegee element is established for picking-up dirt and liquid particles from the floor. A suction area of under-pressure is defined in between the squeegee element, the brush and the housing, wherein said housing also extends substantially parallel to the brush axis.

In a further preferred embodiment of the present invention said squeegee element comprises switching means for switching the squeegee element to a closed position, in which the squeegee element is adapted to push or wipe dirt particles and liquid across or off the surface to be cleaned, when the cleaning device is moved on the surface in a forward direction, in which the squeegee element is, seen in the direction of movement of the cleaning device, located behind the brush, and for switching the squeegee element to an open position, in which dirt particles and liquid from the floor can enter the suction area through an opening between the squeegee element and the surface to be cleaned, when the cleaning device is moved on the surface in a backward direction, in which the squeegee element is, seen in the direction of movement of the cleaning device, located in front of the brush.

The ability to switch the squeegee element from an open to a close position depending on the movement direction of the cleaning device enables a good cleaning result in a forward as well as in a backward stroke of the nozzle. The open configuration is in order to allow the dirt to enter when the squeegee approaches dirt and liquid on the floor before the brush. And in the closed position the squeegee closes the gap to the floor, or in other words wipes or glides over the floor, when the brush approaches the dirt or liquid on the floor before the squeegee.

In order to guarantee this switching mode the squeegee element is preferably realized by a flexible rubber lip that, depending on the movement direction of the cleaning device, is adapted to flex about the longitudinal direction of said rubber lip. This rubber lip preferably comprises at least one stud which is arranged near the lower end of the rubber lip, where the rubber lip is intended to touch the surface to be cleaned. Said at least one stud is being adapted to at least partly lift the rubber lip from the surface, when the cleaning device is moved on the surface in a backward direction, in which the rubber lip is, seen in the direction of movement of the cleaning device, located in front of the brush. Due to this lifting of the rubber lip in a backward stroke of the nozzle, in which the squeegee element approaches dirt on the floor before the brush, coarse dirt may enter the nozzle also in a backward stroke through the opening created between the squeegee element and the surface to be cleaned. When moving the cleaning device on the surface in the opposite, forward direction said stud is free from contact to the floor, leaving the rubber lip freely glide over the floor in order to pick-up dirt and water particles from said floor.

According to a further preferred embodiment of the present invention, the cleaning device further comprises a restriction element, which is arranged in the suction area for at least partly restricting the suction effect between the suction inlet and the suction outlet. Said restriction element may be arranged at any position within the nozzle housing between the suction inlet and the suction outlet. It preferably extends parallel to the nozzle housing and the brush axis along the entire length side of the brush and/or of the housing, respectively.

The restriction element is adapted to at least partly restrict the suction effect that occurs due to the generated under-pressure in the suction area in the space between the suction inlet and the suction outlet. In this way, a relatively constant operating point of the system is created. This is especially advantageous in situations in which the suction inlet may be congested by a great amount of dirt or liquid. For example, in a case where a paper or another larger fragment is ingested by the suction inlet, this may lead to a congestion at the suction inlet or at any other position within the suction area. This would result in a different operating point of the vacuum aggregate.

A similar effect occurs in the above-mentioned case, in which the squeegee switches from its open to its closed position. In its open position an opening is created between the squeegee element and the surface to allow dirt to enter the nozzle in a backward stroke of the device. This also results in a rather large air leakage enabling additional air to enter the suction inlet through the created opening. On the other hand, the squeegee at least partly seals the suction area when being in its closed position, gliding or wiping over the surface during a forward stroke of the device.

The switching of the squeegee thus also results in a pressure change within the suction area that is unwanted. In order to realize a constant under-pressure and flow-rate the vacuum aggregate thus also would need to be switched between two operating points. Enabling these two operating points would require a complex system with an expensive, especially adapted vacuum aggregate.

This problem is overcome by the provided restriction element that determines an almost constant air flow between the suction in- and outlet, independent of the situation at the suction inlet and independent of the position of the squeegee (open or closed position).

According to an embodiment, said restriction element is realized by a housing part that decreases the distance between the housing and the brush at a position in the suction area between the suction inlet and the suction outlet. Thereto, the housing is preferably arranged concentrically, or at least partly concentrically to the brush. The said part of the housing decreases the radial distance between the brush and the housing at any position between the suction in- and outlet. In this way, a kind of flow restriction is formed by the brush and an inner wall of the nozzle housing. Thus, the suction channel (also denoted as suction area) appears to be almost closed for air, dirt and liquid to pass this position. However, due to the above-mentioned properties of the brush elements, a constant amount of air, dirt and liquid is still transported through the space in between the brush elements. This results in a relatively constant operating point of the system. The applied load of the vacuum aggregate is thus minimal, which again results in a longer lifetime of the vacuum aggregate. Further, the minimal applied load reduces the noise production of the vacuum aggregate. Besides that, it may result in a smaller required size and weight of the vacuum aggregate, which again results in a cheaper solution for the user. Further, it increases the freedom of design for the manufacturer.

In other words, the restriction element divides the suction area in two subzones. The first subzone is located in a space between the brush and the nozzle housing that is arranged between the suction inlet and the restriction element, whereas the second subzone is located in a space between the brush and the nozzle housing that is arranged between the restriction element and the suction outlet. Due to the flow restriction a constant under-pressure and flow-rate may be applied in said second subzone, wherein the under-pressure and flow-rate applied in the second subzone are independent of the pressure properties in the first subzone. It is to be noted that the above-mentioned pressure ranges of e.g. 5 to 30 mbar in this embodiment denote the under-pressure in said second subzone, whereas higher pressures might occur in the first subzone.

Since the brush needs space for the above-mentioned self-cleaning process during the dirt release period, the restriction element, e.g. said part of the housing, preferably takes up only a small part of the suction area. To receive a good self-cleaning result, the restriction element is preferably arranged close to the nozzle inlet in order to guarantee for enough space between the restriction element and the nozzle outlet. In other words, the above-mentioned first subzone of the suction area is preferably smaller than said second subzone of the suction area.

According to a further embodiment, said restriction element is realized by a housing part that contacts the brush at a position in the suction area between the suction inlet and the suction outlet. A contact of the brush and the nozzle housing at the position of the restriction element realizes a further sealing effect that is similar to the above-mentioned sealing effect at said first and second positions. A contact of the brush and the nozzle housing has shown to result in a maximum degree of flow restriction. This again results in a rather constant suction within the second subzone and leads to an almost constant operating point at which the vacuum aggregate needs to be driven for realizing a constant under-pressure and flow-rate. Due to the above-mentioned properties of the brush elements, a constant amount of air, dirt and liquid may, also in this case, be transported through the space in between the brush elements.

According to an embodiment of the present invention, the drive means are adapted to realize a centrifugal acceleration at tip portions of the brush elements of at least 3,000 $m/s^2$, in particular during a dirt release period when the brush elements are free from contact to the surface during rotation of the brush. According to a further embodiment, it is preferable that the drive means are adapted to realize a centrifugal acceleration at the tip portions of at least 7,000 $m/s^2$ and more preferably a centrifugal acceleration of 12,000 $m/s^2$.

It is to be noted that the minimum value of 3,000 $m/s^2$ in respect of the acceleration which is prevailing at the tip portions, at least during a dirt release period when the brush elements are free from contact to the surface during the rotation of the brush, is supported by results of experiments which have been performed in the context of the present invention. These experiments have shown that cleaning performances of the device according to the present invention improve with an increase of the angular velocity of the brush, which implies an increase of the acceleration at the tip portions of the brush elements during rotation. Further, these experiments have shown that the sealing effect is improved at these accelerations.

When the drive means are adapted to realize centrifugal accelerations of the brush elements in the above-mentioned ranges, it is likely for the liquid droplets adhering to the brush elements to be expelled as a mist of droplets during a phase in which the brush elements are free from contact to the surface to be cleaned, i.e. during a phase in which the brush elements are located within the nozzle housing.

According to a further preferred embodiment, a linear mass density of a plurality of the brush elements is, at least at tip portions of the brush elements, lower than 150 g per 10 km, preferably lower than 20 g per 10 km.

The brush elements may be made of a plastic material, wherein polyester and nylon are suitable examples. The linear mass density of a plurality, or preferably of a majority of the brush elements is, at least at the tip portions, lower than 150 g per 10 km, preferably lower than 20 g per 10 km. In this case, the brush elements can be classified as very soft and flexible, contrary to many situations known from the art. This ensures that, at least at the tip portions, the brush elements are flexible enough to undergo a bending effect and are able to pick-up dirt particles and liquid droplets from the surface to be cleaned. A deformation of the brush elements, or, to say it more accurately, a speed at which deformation can take place, is influenced by said linear mass density of the brush elements Furthermore, the linear mass density of the brush elements influences the power which is needed for rotating the brush. When the linear mass density of the brush elements is relatively low, the flexibility is relatively high, and the power needed for causing the brush elements to bend when they come into contact with the surface to be cleaned is relatively low. This also means that a friction power, which is generated between the brush elements and the surface, is low, whereby heating of the surface and associated damage of the surface are prevented. Other advantageous effects of a relatively low linear mass density of the brush elements are a relatively high resistance to wear and tear, a relatively small chance of damage by sharp objects or the like, and the capability to follow the surface in such a way that contact is maintained even when a substantial unevenness in the surface is encountered.

It is to be noted that the linear mass density as mentioned, i.e. the linear mass density in grams per 10 km, is also denoted as Dtex value.

The experiments carried out by the applicant have proven that a Dtex value in the above-mentioned range appears to be technically possible and that good cleaning results can be obtained therewith. However, it has shown that cleaning results can be further improved by applying brush elements with an even lower upper limit of the Dtex value, such as a Dtex value of 125, 50, 20 or even 5 (in g/km).

The combination of the linear mass density of the brush elements and the above-mentioned accelerations at the tips of the brush elements is a combination which yields optimal cleaning performance of the rotatable brush, wherein practically all dirt particles and spilled liquid encountered by the brush are picked-up by the brush elements and expelled at a position inside the nozzle housing. Naturally, effective pick-up of particles and liquid is advantageous when it comes to cleaning, wherein both a dirt removal and a drying process are realized at the same time. An effective subsequent expelling process is advantageous in view of the fact that a re-introduction of dirt and/or liquid to the surface to be cleaned is avoided. With the brush according to the present invention in combination with the above-mentioned squeegee element and the operating parameters which are realized by the drive means, it is possible to catch particles into droplets making the particles effectively larger which enables for an easier filtering. Besides that, this parameter combination further increases the above-mentioned sealing effect at said first and second positions and, in case an above-mentioned further restriction element is provided, also the sealing effect at the position of the restriction element.

The combination of the above-mentioned parameters concerning the linear mass density and the realized centrifugal acceleration at the tip portions of the brush elements is not found on the basis of knowledge of the prior art. The prior art is not even concerned with the possibility of having an autonomous, optimal functioning of only one rotatable brush which is used for cleaning a surface and is also able to lift dirt and liquid, and thus being able to reduce the number of required squeegee elements by still realizing the same or even improving the cleaning properties.

When at least one rotatable brush is provided and operated as described by the present invention, it is ensured that liquid can be effectively removed from a surface to be cleaned, and that the same goes for dirt particles, which may be caught by the brush elements of the brush and/or be taken along with liquid. The cleaning process which is performed on one side of the nozzle housing by a rotatable brush brushing the surface, and, on the other side by a squeegee element constantly contacting the surface and thereby wiping the surface, is especially suitable to be applied on hard surfaces. Examples of hard surfaces are hard floors, windows, walls, table tops, plates of hard material, sidewalls, etc.

According to a further preferred embodiment, the cleaning device comprises positioning means for positioning the brush axis at a distance to the surface to be cleaned that is smaller than the radius of the brush with fully outstretched brush elements to realize an indentation of the brush part contacting the surface during operation, which indentation is in a range from 2% to 12% of the brush diameter.

As a result, the brush elements are bent when the brush is in contact with the surface. Hence, as soon as the brush elements come into contact with a surface during rotation of the brush, the appearance of the brush elements changes from an outstretched appearance to a bent appearance, and as soon as the brush elements loose contact with the surface during rotation of the brush, the appearance of the brush elements changes from a bent appearance to an outstretched appearance. Furthermore, the indentation of the brush increases the above-described sealing effect between the brush and the surface at said second position. It is to be noted that an indentation in a similar or even the same range as mentioned above may also be set between the brush and the nozzle housing. This may be realized by providing positioning means for positioning the brush axis at a distance to nozzle housing that is smaller than the radius of the brush with fully outstretched brush elements to realize an indentation of the brush part contacting the housing at said first position during operation, which indentation is in a range from 2% to 12% of the brush diameter. This also leads to an increase of the above-described sealing effect between the brush and the nozzle housing at said first position.

A practical range for an indentation of the brush is arranged from 2% to 12% of a diameter of the brush relating to a fully outstretched condition of the brush elements. In practical situations, the diameter of the brush as mentioned can be determined by performing an appropriate measurement, for example, by using a high-speed camera or a stroboscope which is operated at the frequency of a rotation of the brush.

When brush elements come into contact with a dirt particle or liquid, or, in case an indentation of the brush with respect to the surface is set, the brush elements are bent. As soon as the brush elements with the dirt particles and liquid adhering thereto loose contact with the surface, the brush elements are straightened out, wherein especially the tip portions of the brush elements are moved with a relatively high acceleration. As a result, the centrifugal acceleration at the top portions of the brush elements is increased. Hence, the liquid droplets and dirt particles adhering to the brush elements are launched from the brush elements, as it were, as the acceleration forces are higher than the adhesive forces, as this has been mentioned according to the embodiment above.

A factor which may play an additional role in the cleaning function of the rotatable brush is a packing density of the brush elements. When the packing density is large enough, capillary effects may occur between the brush elements, which enhance fast removal of liquid from the surface to be cleaned. According to an embodiment of the present invention the packing density of the brush elements is at least 30 tufts of brush elements per $cm^2$, wherein a number of brush elements per tuft is at least 500.

Arranging the brush elements in tufts forms additional capillary channels, thereby increasing the capillary forces of the brush for picking-up dirt particles and liquid droplets from the surface to be cleaned.

In order to realize the above-mentioned centrifugal accelerations at the tips of the brush elements the drive means are, according to an embodiment of the present invention, adapted to realize an angular velocity of the brush, which is in a range of 3,000 to 15,000 revolutions per minute, more preferably in a range of 5,000 to 8,000 revolutions per minute, during operation of the device. Experiments of the applicant have shown that optimal cleaning results can be obtained, when the brush is driven at an angular velocity which is at least 6,000 revolutions per minute.

However, the desired centrifugal accelerations at the tip portions of the brush elements do not only depend on the angular velocity, respectively on the frequency of the brush, but also on the radius, respectively on the diameter of the brush. It is therefore, according to a further embodiment of the invention, preferred that the brush has a diameter which is in a range of 10 to 100 mm, more preferably in a range of 20 to 80 mm, most preferably in range of 35 to 50 mm, when the brush elements are in a fully outstretched condition, and wherein the length of the brush elements is in a range of 1 to 20 mm, preferably in a range of 8 to 12 mm, when the brush elements are in a fully outstretched condition.

As it has been mentioned above, the presented cleaning device has the ability to realize extremely good cleaning results. These cleaning results can be even improved by actively wetting the surface to be cleaned. This is especially advantageous in case of stain removal. The liquid used in the process of enhancing adherence of dirt particles to the brush elements may be provided in various ways. In a first place, the rotatable brush and the flexible brush elements may be wetted by a liquid which is present on the surface to be cleaned. An example of such a liquid is water, or a mixture of water and soap. Alternatively, a liquid may be provided to the flexible brush elements by actively supplying the cleansing liquid to the brush, for example, by oozing the liquid onto the brush, or by injecting the liquid into a hollow core element of the brush.

According to an embodiment, it is therefore preferred that the cleaning device comprises means for supplying a liquid to the brush at a rate which is lower than 6 ml per minute per cm of a width of the brush in which the brush axis is extending. It appears that it is not necessary for the supply of liquid to take place at a higher rate, and that the above-mentioned rate suffices for the liquid to fulfill a function as a carrying/transporting means for dirt particles. Thus, the ability of removing stains from the surface to be cleaned can be significantly improved. An advantage of only using a little liquid is that it is possible to treat delicate surfaces, even surfaces which are indicated as being sensitive to a liquid such as water. Furthermore, at a given size of a reservoir containing the liquid to be supplied to the brush, an autonomy time is longer, i.e. it takes more time before the reservoir is empty and needs to be filled again.

It has to be noted that, instead of using an intentionally chosen and actively supplied liquid, it is also possible to use a spilled liquid, i.e. a liquid which is to be removed from the surface to be cleaned. Examples are spilled coffee, milk, tea, or the like. This is possible in view of the fact that the brush elements as mentioned before, are capable of removing the liquid from the surface to be cleaned, and that the liquid can be removed from the brush elements under the influence of centrifugal forces as described in the foregoing. The above-mentioned effect of re-spraying the surface in the area between the brush and the squeegee is overcome by the squeegee element which collects this re-sprayed liquid and dirt by acting as kind of wiper, so that remaining liquid and dirt may then be ingested due to the applied under-pressure. The squeegee thus ensures that the remaining liquid and dirt is not leaving the suction area again without being ingested by the vacuum aggregate. It therefore kind of closes the suction area for dirt and liquid on one side of the nozzle housing. The combination of the selected brush with the squeegee thus results in a very good cleaning and drying effect.

BRIEF DESCRIPTION OF THE DRAWINGS

These and other aspects of the invention will be apparent from and elucidated with reference to the embodiment(s) described hereinafter. In the following drawings

DETAILED DESCRIPTION OF EMBODIMENTS

Figure 1:
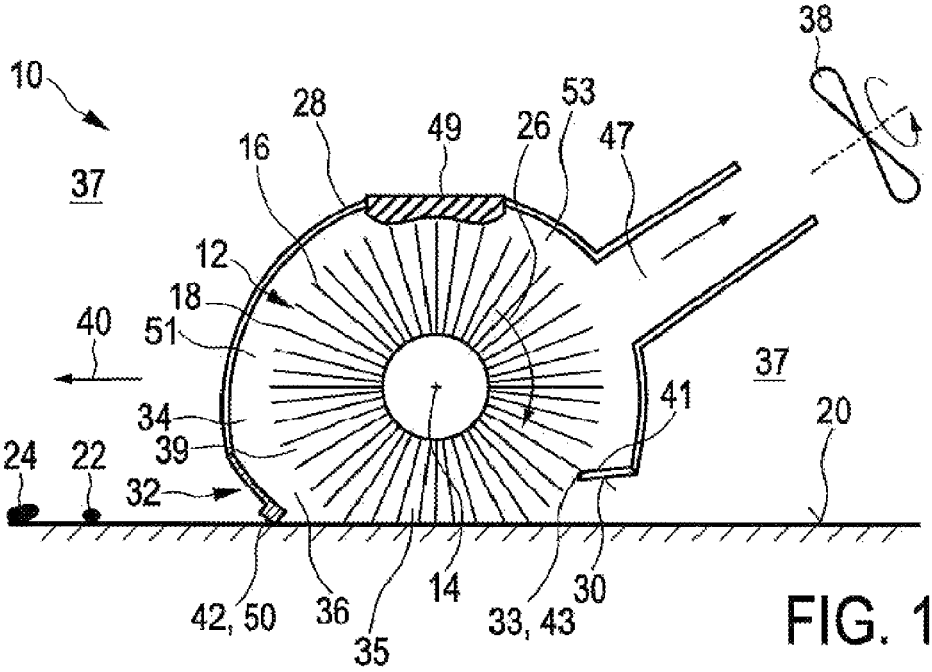
FIG. 1 shows a schematic cross-section of a first embodiment of a nozzle arrangement of a cleaning device according to the present invention, in a first working position.
Figure 2:
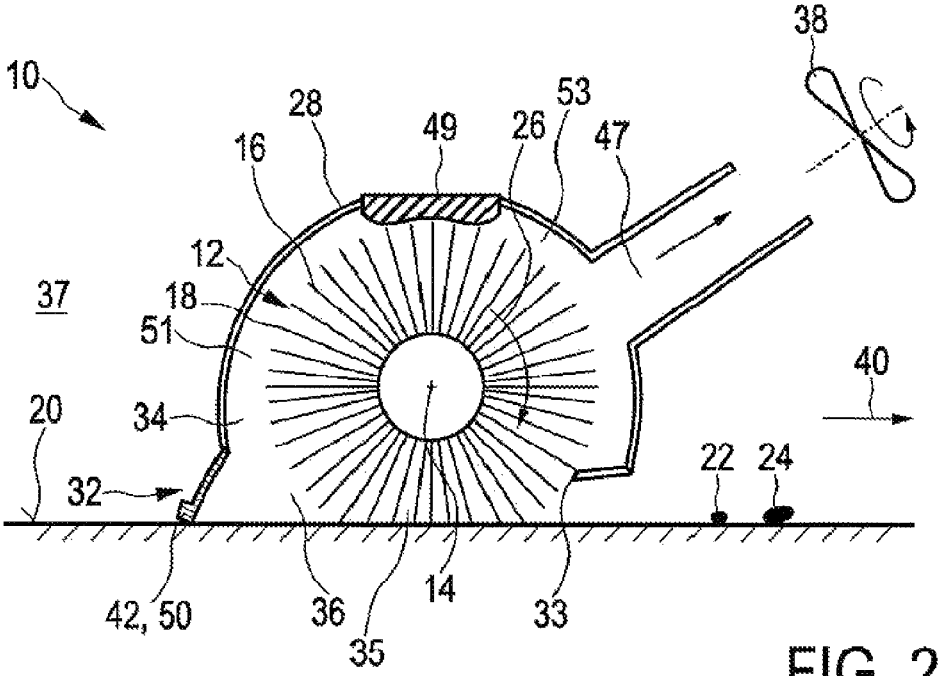
FIG. 2 shows a schematic cross-section of the first embodiment of the nozzle arrangement shown in FIG. 1, in a second working position.

FIGS. 1 and 2 show a schematic cross-section of a first embodiment of a nozzle arrangement 10 of a cleaning device 100 according to the present invention.

In FIG. 1 the nozzle arrangement 10 is shown in a first working position, whereas in FIG. 2 the nozzle arrangement 10 is shown in a second working position. The nozzle arrangement 10 comprises a brush 12 that is rotatable about a brush axis 14. Said brush 12 is provided with flexible brush elements 16, which are preferably realized by thin microfiber hairs. The flexible brush elements 16 are substantially uniformly distributed over the periphery of the brush 12. Furthermore, the flexible brush elements 16 comprise tip portions 18 which are adapted to contact a surface to be cleaned 20 during the rotation of the brush 12 and to pick-up dirt particles 22 and liquid 24 from said surface 20 during a pick-up period when the brush elements 16 contact the surface 20.

Further, the nozzle arrangement 10 comprises a drive means, e.g. a motor (not shown), for driving the brush 12 in a predetermined direction of rotation 26. The brush 12 is at least partly surrounded by a nozzle housing 28. The arrangement of the brush 12 within the nozzle housing 28 is preferably chosen such that the brush 12 at least partially protrudes from a bottom side 30 of the nozzle housing 28, which, during use of the device 100, faces the surface to be cleaned 20.

Also attached to said bottom side 30 of the nozzle housing 28 is a squeegee element 32. The squeegee element 32 is spaced apart from the brush 12 and arranged on a side of the brush 12, where the brush elements 16 enter the housing 28 during the rotation of the brush 12. The squeegee 32 may be used as a kind of wiping element for pushing or wiping dirt particles 22 and liquids 24 across or off the surface 20, when the cleaning device 100 is moved. Said squeegee 32 preferably extends substantially parallel to the brush axis 14.

During the rotation of the brush 12, the brush elements 16 substantially form a sealing with the housing 28 at a first position 33, where the brush elements 16 leave the housing 28 during rotation. A further sealing is realized between the brush 12 and the surface 20 at a second position 35, where the brush 12 contacts the surface 20 during its rotation. In this way, a suction area 34 is defined in a space between the brush 12, the housing 28 and the surface 20, which is at least partly sealed at said first and second positions 33, 35. It is to be noted that the suction area 34, in the meaning of the present invention, not only denotes an area that is defined between the brush 12, the squeegee 32 and the nozzle housing 28, but also denotes the space between the brush elements 16 for the time during the rotation of the brush 12, in which the brush elements 16 are inside the nozzle housing 28, as well as it denotes the area between the squeegee 32 and the brush 12. The latter area will be in the following also denoted as suction inlet 36 which opens into the suction area 34.

"Sealing" or "sealed" in the context of the present invention does not mean a complete sealing to the surrounding area 37 of the nozzle 10 or a generation of a completely sealed vacuum within the suction area 34, since otherwise dirt 22 and liquid 24 could not be picked up from the surface 20 anymore. "Sealing" or "sealed" in the context of the present invention rather refers to a situation in which an air leakage at the above-mentioned two positions 33, 35 is reduced to a minimum constant flow-rate, or in other words, in which only a small amount of air is able to pass the area in between the housing 28 and the brush 12 at said first position 33 and in between the brush 12 and the surface 20 at said second position 35. In this way, a kind of restriction is created preventing an unwanted, too high air leakage at the described two positions 33, 35. The most part of the air is guided in a space 39 that occurs between the brush elements 19.

The sealing properties of the brush 12 rely on the fact that a brush 12 is used, which is provided with flexible brush elements 16 that are substantially uniformly distributed over the periphery of the brush 12. By driving the brush 12 in rotation with a drive means (not shown), the flexible brush elements 16 are straightened out due to the occurring centrifugal accelerations, become stiff, and thereby form a kind of "wall". Thus, the driven brush elements 16, in the figurative sense, behave like a forest with many trees where the trees impede the wind flow. Said "wall" can be imagined as an almost uniform cylinder. This cylinder is, however, not completely closed. Very thin spaces 39 occur between the thin fiber hairs 16 of the brush 12, in which dirt particles 22 and liquid droplets 24 may be transported. This transport of the dirt 22 and liquid particles 24 mainly relies on adhesive and/or capillary forces that occur in said spaces 39 in between of the brush elements 16. This adhesive and/or capillary effect is especially distinctive if the brush elements 16 have a small material density. Since the brush elements 16 are realized as thin microfiber hairs that use to be flexible, the so-called "wall-effect" as well as the "sealing-effect" of the fibers 16 just occur during the rotation of the brush 12, whereas the brush-elements 16 more or less dangle if the brush 12 is not rotated.

The sealing at said first position 33 is, for example, realized by arranging the nozzle housing 28 or a part 41 of the housing 28 so close to the brush 12 in an area where the brush elements 12 leave the housing 28, such that a thin channel 43 is formed between the housing 28 and the brush 12 in this area. A distance of approximately 0.5 mm between the housing 28 and the brush 12 has shown good sealing results.

Figure 3:
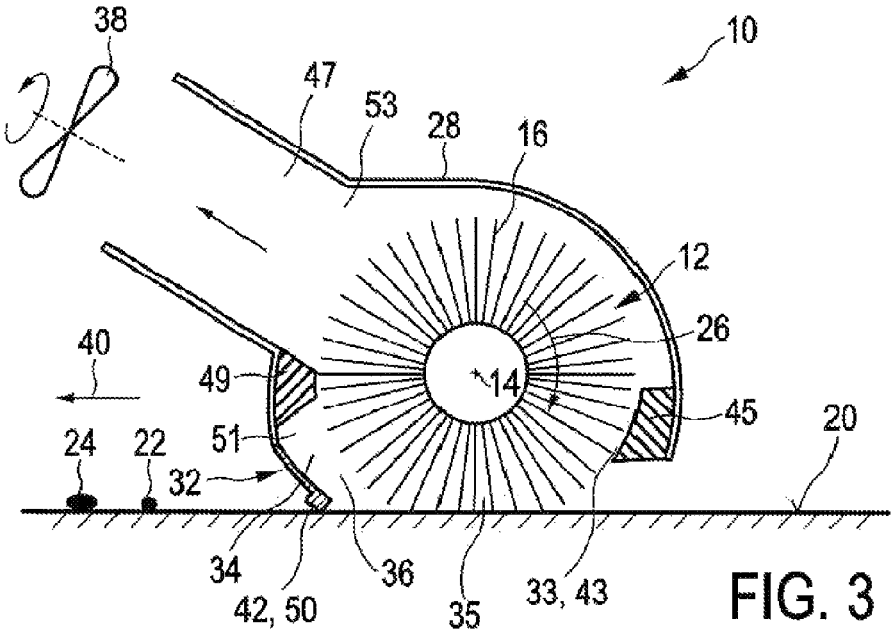
FIG. 3 shows a schematic cross-section of a second embodiment of the nozzle arrangement of the cleaning device according to the present invention, in a first working position.

According to another embodiment said thin channel 43 between the housing 28 and the brush 12 is formed by a constriction 45 of the housing 28, which is arranged at said first position 33, which is exemplarily shown in FIG. 3. This constriction 45 preferably extends parallel to the brush 12, to say it more accurately, parallel to the peripheral direction of brush 12. Such a constriction 45 (shown in FIG. 3) forms in contrast to the housing part 41 (shown in FIG. 1) a longer channel 43 that further increases the sealing effect. It is to be noted that the sealing effect increases with the length of the channel 43, wherein said length denotes a dimension in the peripheral direction of the brush 12. Further, the sealing effect depends on the distance between the brush 12 and the housing 28, wherein said distance denotes a dimension in the radial direction of the brush 12.

By means of a vacuum aggregate 38, which is shown in a schematic way, an under-pressure is generated in the suction area 34 for ingesting dirt particles 22 and liquid 24 that have been encountered and collected by the brush 12 and the squeegee 32. The vacuum aggregate 38 is connected to a suction outlet 47 of the nozzle 10 that leads into the suction area 34. According to the present invention said under-pressure preferably ranges between 3 and 70 mbar, more preferably between 4 and 50 mbar, and most preferably between 5 and 30 mbar. This under-pressure is, compared to regular vacuum cleaners which apply an under-pressure of 70 mbar and above, quite low. However, due to the above mentioned properties of the brush 12, very good cleaning results may already be realized in the above-mentioned pressure ranges. Thus, also smaller vacuum aggregates 38 may be used. This increases the freedom in the selection of the vacuum pump.

Figure 12:
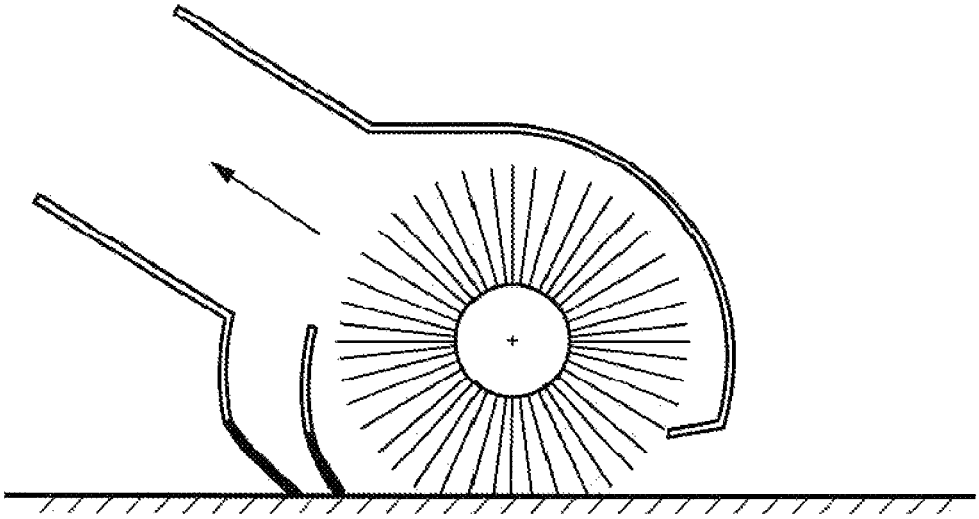
FIG. 12 shows a schematic cross-section of a first example of a nozzle arrangement according to the state of the art.
Figure 13:
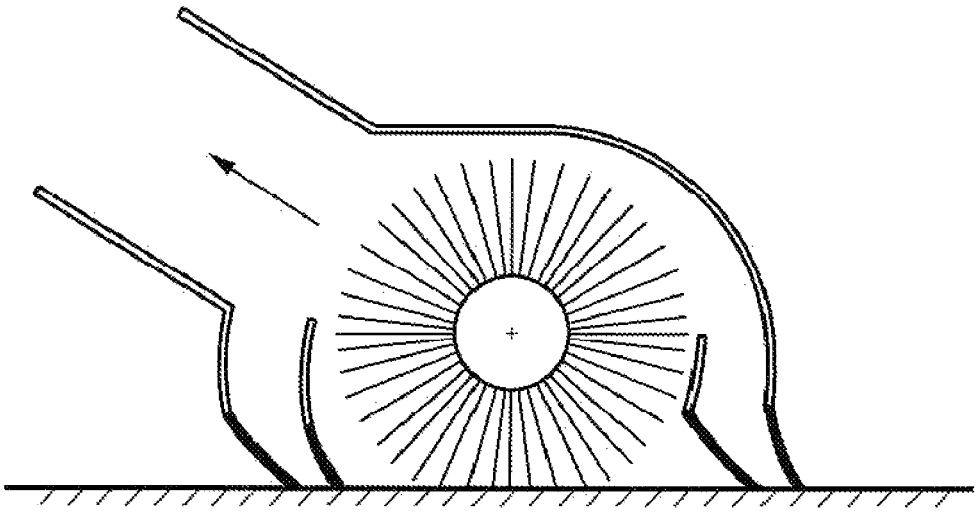
FIG. 13 shows a schematic cross-section of a second example of a nozzle arrangement according to the state of the art.
Figure 14:
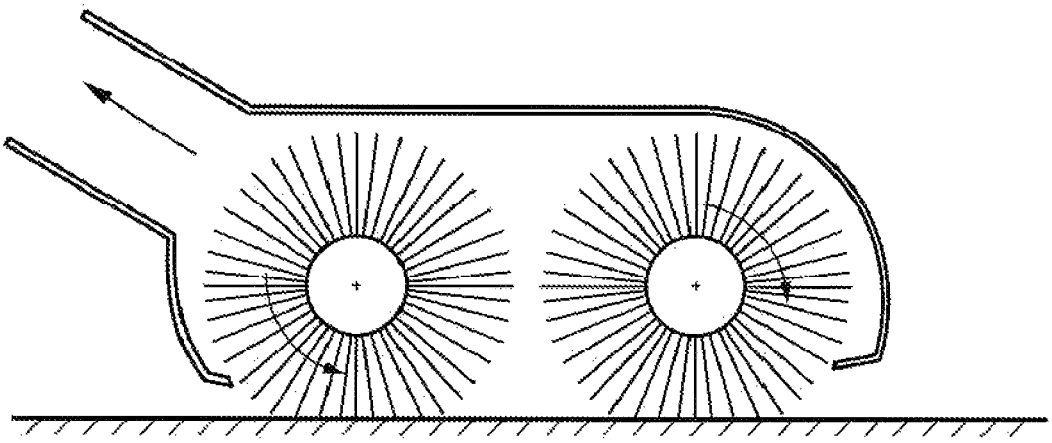
FIG. 14 shows a schematic cross-section of a third example of a nozzle arrangement according to the state of the art.
Figure 15:
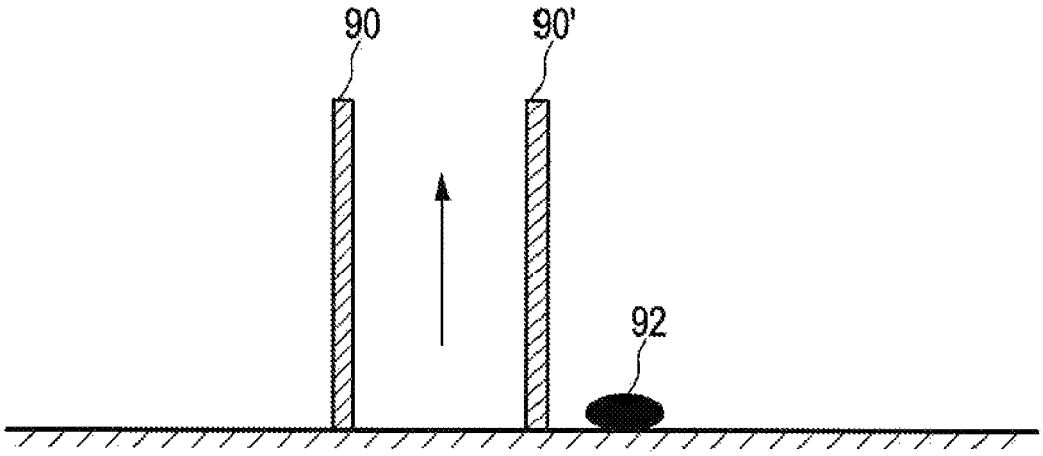
FIG. 15 shows a schematic cross-section of a fourth example of a nozzle arrangement according to the state of the art.

Due to the ability of the brush 12 to also pick-up water 24, a double squeegee solution as this is exemplarily shown in FIGS. 12 and 13 is no longer necessary. This mainly relies on the fact that water is not only picked-up from the floor 20 due to the generated under-pressure, but also actively lifted from the floor 20 by means of the brush 12. Even if the nozzle 10 is moved across the surface 20 in a backward stroke as shown in FIG. 1 water 24 and dirt particles 22 that remain on the surface 20 after passing the squeegee 32 and the suction inlet 36, i.e. water and dirt which were not directly ingested from the surface 20 by the under-pressure applied in the suction area 34 at the suction inlet 36, is then encountered by the brush 12 and lifted thereby. A backward stroke in this meaning denotes a movement of the nozzle arrangement 10 in an intended movement direction 40, in which the squeegee element 32 encounters dirt and liquid particles 22, 24 present on the surface 20 before they are encountered by the brush 12. This situation is exemplarily shown in FIG. 1.

In case the brush 12 is actively sprayed with water, which is in practice often done to improve the removal of stains in the surface 20, such a backward stroke would leave behind the cleaning liquid on the surface if the brush 12 was not able to also pick-up the sprayed water again. In this case an additional squeegee would have to be used in order to guarantee the water removal from the floor 20. However, this is due to the presented properties of the brush 12, the speed with which the brush 12 is driven and the combination with the squeegee 32 not necessary according to the present invention.

In order to guarantee a good cleaning result in the backward stroke (indicated by arrow 40, shown in FIG. 1) as well as in a forward stroke (indicated by arrow 40, shown in FIG. 2), the squeegee element 32 preferably comprises switching means 42 for switching the squeegee 32 from an open to a closed position and vice versa, depending on the direction of movement 40 of the nozzle 10 with respect to the surface 20. If the nozzle is moved in a forward stroke (shown in FIG. 2) where the squeegee element 32 is, seen in the direction of movement 40 of the cleaning device 100, located behind the brush, the squeegee 32 is arranged in a closed position. In this closed position the squeegee 32 is adapted to push or wipe dirt particles 22 and liquid 24 across or off the surface 20 by more or less gliding over the surface 20. In such a forward stroke the squeegee 32 acts as a kind of wiper that collects the remaining water from the surface 20, which has not been lifted or has been sprayed back from the brush 12 to the surface 20. The remaining water which is collected by the squeegee 32 can then be ingested by means of the applied under-pressure within the suction area 34.

On the other hand, the squeegee 32 is arranged in its open position when the nozzle 10 is moved in a backward stroke (shown in FIG. 1), in which the squeegee 32 is, seen in the direction of movement 40, located in front of the brush 12, so that it would encounter the dirt particles 22 and the liquid 24 on the surface 20 before they would be encountered by the brush 12. In this backward stroke the switching elements 42 switch the squeegee 32 to its open position, wherein dirt particles and liquid from the surface 20 can enter the suction area 34 through an opening 44 in between the squeegee 32 and the surface to be cleaned 20. In this way, dirt particles 22 and liquid 24 are also able to enter the suction area 34 at the position of the suction inlet 36 and encounter the brush 12 with which they are picked-up from the surface 20.

If the squeegee 32 would not be switched to said open position, only very small dirt particles 22 would be able to reach the suction inlet 36, while most of the dirt 22 and liquid 24 would be entangled by the squeegee 32 and pushed across the surface 20 without being able to enter the suction area 34. This would of course result in a poor cleaning and drying effect.

Figure 6A:
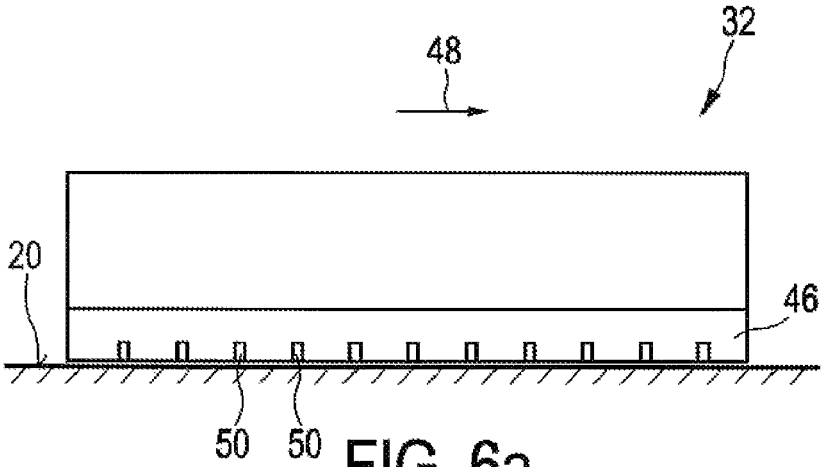
FIG. 6 shows a schematic top view (FIG. 6*a*) and a schematic cross-section (FIG. 6*b*) of a squeegee element of the cleaning device according to the present invention, in a first working position.
Figure 6B:
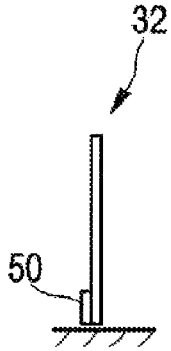
Figure 7A:
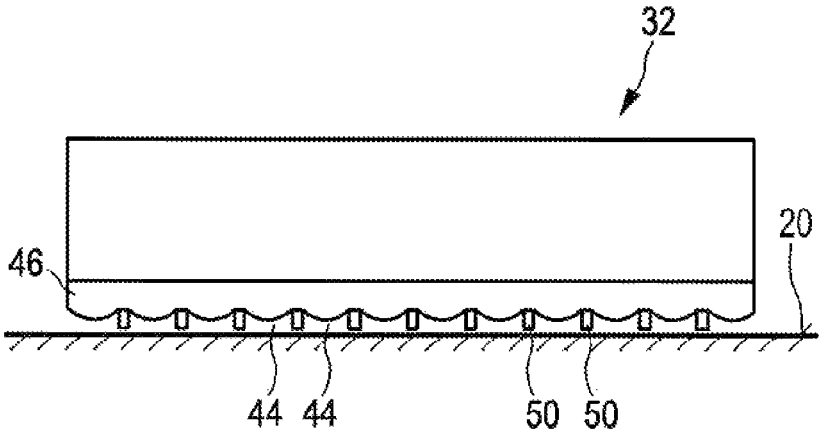
FIG. 7 shows a schematic top view (FIG. 7*a*) and a schematic cross-section (FIG. 7*b*) of the squeegee element shown in FIG. 6, in a second working position.
Figure 7B:
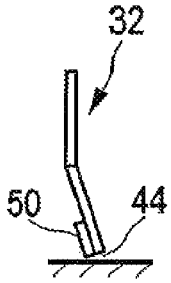

In order to guarantee this direction-dependent switching of the squeegee element 32, the squeegee 32 preferably comprises a flexible rubber lip 46 that, depending on the movement direction 40 of the cleaning device 100, is adapted to flex about a longitudinal direction of said rubber lip 46. An enlarged schematic view of the squeegee 32 is shown in FIGS. 6 and 7. FIG. 6 shows the squeegee 32 in its closed position, whereas FIG. 7 shows a situation of the squeegee 32 in its open position.

Studs 50 that are arranged near the lower end of the rubber lip 46, where the squeegee 32 is intended to touch the surface 20, are adapted to at least partly lift the rubber lip 46 from the surface 20, when the cleaning device is moved on the surface 20 in a backward direction 40 (as shown in FIG. 1), in which the rubber lip 46 is, seen in the direction of movement 40, located in front of the brush 12. In this case the rubber lip 46 is lifted, which is mainly due to the natural friction which occurs between the surface 20 and the studs 50, which act as a kind of stopper that decelerates the rubber lip 46 and forces it to flip over the studs 50. The squeegee 32 is thereby forced to glide on the studs 50, wherein the rubber lip 46 is lifted by the studs 50 and openings 44 occur in the space between the rubber lip 46 and the surface 20 (see FIGS. 7*a* and *b*).

According to an embodiment, the nozzle 10 further comprises a restriction element 49 which is arranged in the suction area 34 between the suction inlet 36 and the suction outlet 47 (see FIGS. 1 to 4). Said restriction element 49 preferably extends parallel to the brush axis 14 along the entire length side of the brush 12 and/or of the housing 28, respectively.

The restriction element 49 is adapted to control the suction effect and the flow-rate that occurs due to the generated under-pressure in the suction area 34 in the space between the suction inlet 36 and the suction outlet 47. The restriction element 49 is realized by a part of the nozzle housing 28 that at least partly protrudes into the suction area 34 and thereby at least partly restricts the suction effect and the flow-rate between the Suction inlet 36 and the suction outlet 47. It decreases the distance between the housing 28 and the brush 12 at a position between the suction inlet 36 and the suction outlet 47. In this way, a kind of flow restriction is formed by the brush 12 and the nozzle housing 28. Thus, the suction channel 34 (also called suction area 34) appears to be almost closed for air, dirt 22 and liquid 24 to pass this position. However, due to the above-mentioned properties of the brush elements 16, a constant amount of air, dirt and liquid is still transported through the space 39 in between the brush elements 16. This results in a relatively constant operating point of the system.

This is especially advantageous, in case the squeegee 32 switches from its open to its close position (FIG. 1 vs. FIG. 2 and FIG. 6 vs. FIG. 7). In the open position of the squeegee 32 additional air can enter the suction inlet 36 through the created openings 44. On the other hand, the squeegee 32 at least partly seals the suction area 34 when being in its closed position. The switching of the squeegee 32 thus results in a pressure change within the suction area 34 that is unwanted.

This problem is overcome by the provided restriction element 49 that determines an almost constant air flow between the suction in- and outlet 36, 47.

The restriction element divides the suction area in two subzones 51, 53. The first subzone 51 is defined between the suction inlet 36 and the restriction element 49. The second subzone 53 is defined between the restriction element 49 and the suction outlet 47.

Since the brush 12 needs space for the above-mentioned self-cleaning process during the dirt release period, the restriction element 49 is preferably as small as possible. "Small" in this case means that the lateral dimension of the restriction element 49, seen in the peripheral direction of the brush 12, is small, in order to form a short tunnel between the restriction element 49 and the brush 12. The restriction element 49 is preferably arranged close to the nozzle inlet 36 in order to guarantee for enough space between the restriction element 49 and the nozzle outlet 47. In other words, the above-mentioned first subzone 51 of the suction area 34 is preferably smaller than said second subzone 53 of the suction area 34.

It is to be noted that the restriction element, however may be arranged anywhere in the suction area 34, as long as it is arranged in between the suction in- and outlet 36, 47. It may also contact the brush 12. A contact of the brush 12 and the nozzle housing 28 has shown to result in a maximum degree of flow restriction. This again results in a rather constant suction within the second subzone 53 and leads to an almost constant operating point at which the vacuum aggregate 38 needs to be driven for realizing a constant under-pressure and flow-rate.

Figure 4:
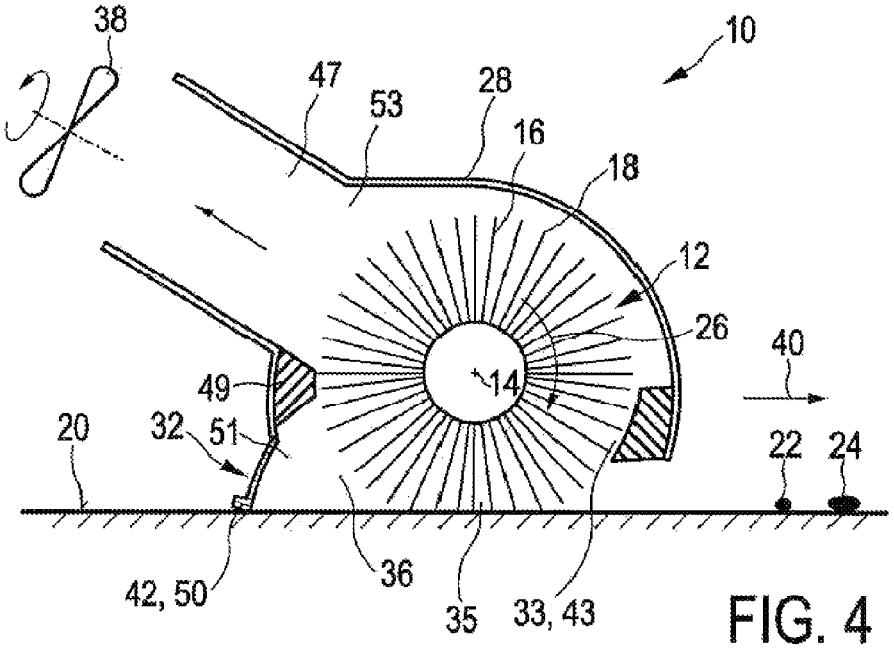
FIG. 4 shows a schematic cross-section of the second embodiment of the nozzle arrangement shown in FIG. 3, in a second working position.

FIGS. 3 and 4, which show a second embodiment of the nozzle arrangement 10, illustrate that the positions of the squeegee 32 and the brush 12 can be, compared to the first embodiment (shown in FIGS. 1 and 2), interchanged without leaving the scope of the present invention. The squeegee 32 is in this case, with respect to the brush axis 14, arranged at the other side of the nozzle housing 28. In this case, the squeegee element 32 of course has to be in an open position, when the nozzle 10 is moved in a forward stroke as shown in FIG. 3, where the nozzle 10 is moved in a direction 40 in which the squeegee 32 is, seen in the direction of movement 40, located in front of the brush 12. Otherwise, the liquid 24 and dirt particles 22 would again not be able to enter the suction area 34, respectively the suction inlet 36.

On the other hand, the squeegee 32 needs to be in its closed position, when the nozzle 10 is according to this embodiment moved in a backward stroke as shown in FIG. 4, where the brush 12 is, seen in movement direction 40, located in front of the squeegee 32 and encounters the dirt and liquid particles 22, 24 first. The squeegee 32 in this case again acts as a wiper that glides over the surface 20 and collects the remaining dirt and liquid particles 22, 24 on the surface 20.

Further, FIGS. 3 and 4 show that the position of the restriction element 49 is changed compared to its position illustrated in FIGS. 1 and 2. However, this is just due to the different nozzle arrangement. The restriction element 49 is again arranged between suction inlet 36 and the suction outlet 47.

By comparing the first embodiment shown in FIGS. 1 and 2 with the second embodiment shown in FIGS. 3 and 4 it is to be noted that the rest of the arrangement, i.e. the properties of the brush as well as the properties of the nozzle housing 28 remain the same. Even the direction of rotation 26 of the brush 12 needs to remain the same, since the direction of rotation 26 of the brush 12 needs to be directed, such that the brush elements 16 enter the nozzle housing 28 on the side of the nozzle housing 28, on which also the squeegee 32 is arranged. Otherwise, this would not enable the above-mentioned interaction of the brush 12 and the squeegee element 32.

Figure 5:
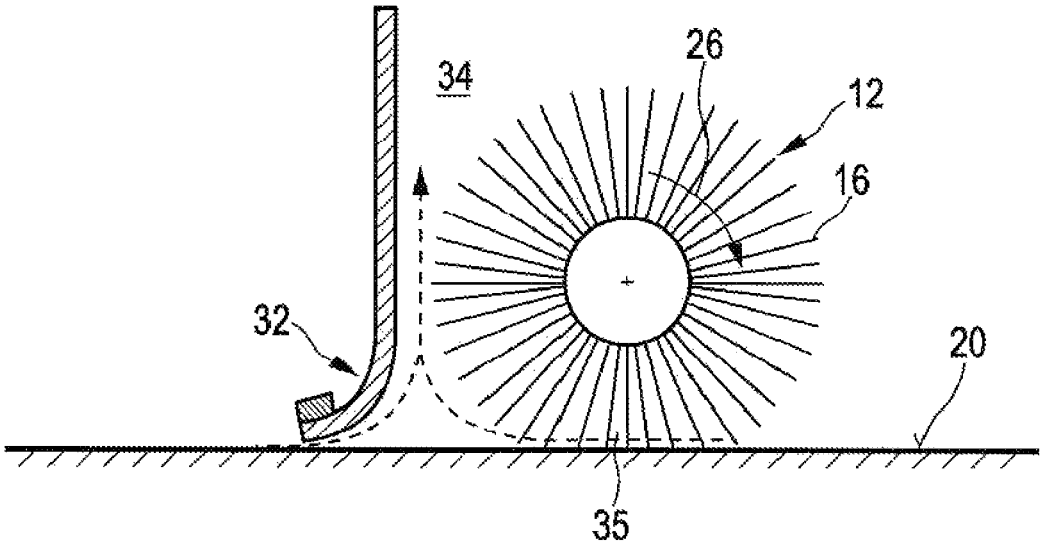
FIG. 5 shows an enlarged view of a brush and a squeegee element to schematically illustrate a principle of the present invention.

FIG. 5 shows an enlarged view of the brush 12 and the squeegee 32 to schematically illustrate the principle of the present invention. A suction channel 34 is formed between the squeegee 32 and the brush 12. Since the air leakage is, due to said sealing properties of the brush 12, reduced to a minimum, the generation of the under-pressure within the suction channel 34, also denoted as suction area 34, can be achieved with a minimum amount of power.

In contrast to brushes used according to the prior art, which are only used for stain removal, a soft brush 12 with flexible brush elements 16 as presented here has the ability to pick up liquid 24 from the surface 20. Thus, a second squeegee element is no longer needed. The sealing brush 12 itself acts as a kind of squeegee, since it is able to pick-up liquid 24 and at the same time reduces the air leakage from the suction area 34 to the surrounding 37 of the nozzle 10. Compared to a squeegee, the sealing brush 12 has furthermore the advantage that it is open for coarse dirt.

In the following, preferred technical properties of the brush 12 and the driving means will be presented. The brush 12 preferably has a diameter which is in a range of 20 to 80 mm. A linear mass density of a plurality, preferably of a majority of the brush elements 16 is, at least at their tip portions 18, chosen to be lower than 150 g/10 km. A width of the brush 12, i.e. a dimension of the brush 12 in a direction in which the rotation axis 14 of the brush 12 is extending, may be in an order of 25 cm, for example.

Figure 9:
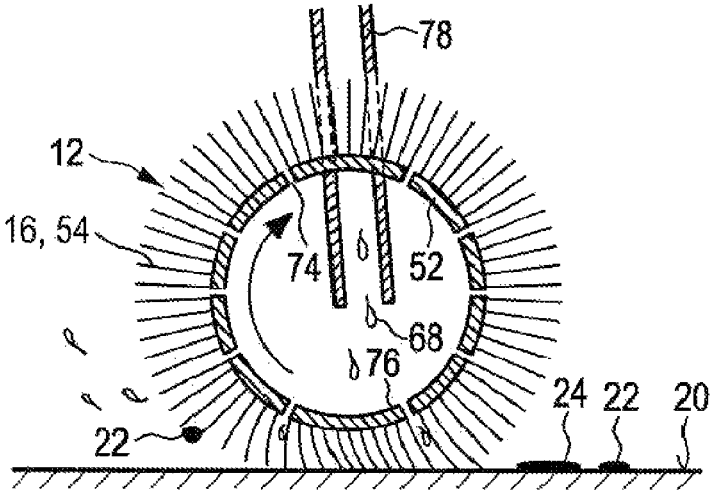
FIG. 9 shows a schematic cross-section of an embodiment of a brush of the cleaning device.

On an exterior surface of a core element 52 of the brush 12, tufts 54 are provided (see e.g. FIG. 9). Each tuft 54 comprises hundreds of fiber elements, which are referred to as brush elements 16. For example, the brush elements 16 are made of polyester with a diameter in an order of about 10 micrometers, and with a Dtex value which is lower than 150 g per 10 km. A packing density of the brush elements 16 may be at least 30 tufts 54 per $cm^2$ on the exterior surface of the core element 52 of the brush 12.

The brush elements 16 do not need to be identical. However, if a linear mass density of a majority of a total number of the brush elements 16 of the brush 12 is lower than 150 g per 10 km, at least at tip portions 18, the above-mentioned sealing effect can be increased. This, however, also requires a higher number of tufts 54.

The driving means may preferably be capable of rotating the brush 12 at an angular velocity which is at least 6,000 revolutions per minute. Further, the drive means may preferably be adapted to realize a centrifugal acceleration at the tip portions 18 of the brush elements 16 which is, in particular during a dirt release period when the brush elements 16 are free from contact to the surface 20 during the rotation of the brush 12, at least 3,000 $m/s^2$.

By means of the rotating brush 12, in particular by means of the brush elements 16 of the rotating brush 12, dirt particles 22 and liquid 24 are picked up from the surface 20, and are transported to a collecting position inside the cleaning device 100. Due to the rotation of the brush 12, a moment occurs at which a first contact with the surface 20 is realized at a first position. The extent of contact is increased until the brush elements 16 are bent in such a way that the tip portions 18 of the brush elements 16 are in contact with the surface 20. The tip portions 18 slide across the surface 20 and encounter dirt particles 22 and liquid 24 in the process, wherein an encounter may lead to a situation in which a quantity of liquid 24 and/or a dirt particles 22 are moved away from the surface 20 to be cleaned and are taken along by the brush elements 16 on the basis of adhesion forces. In the process, the brush elements 16 may act more or less like a whip for catching and dragging particles 22, 24, which is force-closed and capable of holding on to a particle 22, 24 on the basis of a functioning which is comparable to the functioning of a band brake. Furthermore, the liquid 24 which is picked up may pull a bit of liquid with it, wherein a line of liquid is left in the air, which is moving away from the surface 20. The occurring accelerations at the tip portions 18 of the brush elements 16 cause the dirt particles 22 and liquid droplets 24 to be automatically released from the brush 12, when the brush elements loose contact from the floor 20 during their rotation. Since not all dirt particles 22 and liquid droplets 24 may be directly ingested by the vacuum aggregate 38, a small amount of dirt and liquid will be flung back onto the surface 20 in the area where the brush elements 16 loose the contact from the surface 20. However, this effect of re-spraying the surface 20 is overcome by the squeegee element 32 which collects this re-sprayed liquid and dirt by acting as kind of wiper, so that the remaining liquid 24 and dirt 22 may then be ingested due to the applied under-pressure. The liquid 24 and dirt 22 does therefore not leave the suction area 34 again without being ingested.

Applying the above-mentioned technical parameters the brush elements 16 have a gentle scrubbing effect on the surface 20, which contributes to counteracting adhesion of liquid 24 and dirt particles 22 to the surface 20.

As the brush 12 rotates, the movement of the brush elements 16 over the surface 20 continues until a moment occurs at which contact is eventually lost. When there is no longer a situation of contact, the brush elements 16 are urged to assume an original, outstretched condition under the influence of centrifugal forces which are acting on the brush elements 16 as a result of the rotation of the brush 12. As the brush elements 16 are bent at the time that there is an urge to assume the outstretched condition again, an additional, outstretching acceleration is present at the tip portions 18 of the brush elements 16, wherein the brush elements 16 swish from the bent condition to the outstretched condition, wherein the movement of the brush elements 16 is comparable to a whip which is swished. The acceleration at the tip portions 18 at the time the brush elements 16 have almost assumed the outstretched condition preferably meets a requirement of being at least 3,000 $m/sec^2$.

Under the influence of the forces acting at the tip portions 18 of the brush elements 16 during the movement as described, the quantities of dirt particles 22 and liquid 24 are expelled from the brush elements 16, as these forces are considerably higher than the adhesion forces. Hence, the liquid 24 and the dirt particles 22 are forced to fly away in a direction which faces away from the surface 20. The most part of the liquid 24 and the dirt particles 22 is then ingested by the vacuum aggregate. By means of the squeegee element 32 and the under-pressure generated in the suction area 34, as explained above, it is ensured that also the remaining part of the liquid 24 and the dirt 22, that is sprayed back from the brush 12 to the surface 20, is collected and then also ingested.

Under the influence of the acceleration, the liquid 24 may be expelled in small droplets. This is advantageous for further separation processes such as performed by the vacuum fan aggregate 38, in particular the centrifugal fan of the vacuum aggregate 38, which serves as a rotatable air-dirt separator. It is noted that suction forces such as the forces exerted by the centrifugal fan do not play a role in the above-described process of picking up liquid and dirt by means of brush elements 16. However, these suction forces are necessary for picking up the dirt and liquid that has been collected by the squeegee 32.

Besides the functioning of each of the brush elements 16, as described in the foregoing, another effect which contributes to the process of picking up dirt particles 22 and liquid 24 may occur, namely a capillary effect between the brush elements 16. In this respect, the brush 12 with the brush elements 16 is comparable to a brush 12 which is dipped in a quantity of paint, wherein paint is absorbed by the brush 12 on the basis of capillary forces.

It appears from the foregoing that the brush 12 according to the present invention has the following properties:

- the soft tufts 54 with the flexible brush elements 16 will be stretched out by centrifugal forces during the contact-free part of a revolution of the brush 12;
- it is possible to have a perfect fit between the brush 12 and the surface 20 to be cleaned, since the soft tufts 54 will bend whenever they touch the surface 20, and straighten out whenever possible under the influence of centrifugal forces;
- the brush 12 constantly cleans itself, due to sufficiently high acceleration forces, which ensures a constant cleaning result;
- heat generation between the surface 20 and the brush 12 is minimal, because of a very low bending stiffness of the tufts 54;
- a very even pick-up of liquid from the surface 20 and a very even overall cleaning result can be realized, even if creases or dents are present in the surface 20, on the basis of the fact that the liquid 24 is picked up by the tufts 54 and not by an airflow as in many conventional devices; and
- dirt 22 is removed from the surface 20 in a gentle yet effective way, by means of the tufts 54, wherein a most efficient use of energy can be realized on the basis of the low stiffness of the brush elements 16.

On the basis of a relatively low value of the linear mass density, it may be so that the brush elements 16 have very low bending stiffness, and, when packed in tufts 54, are not capable of remaining in their original shape. In conventional brushes, the brush elements spring back once released. However, the brush elements 16 having the very low bending stiffness as mentioned will not do that, since the elastic forces are so small that they cannot exceed internal friction forces which are present between the individual brush elements 16. Hence, the tufts 54 will remain crushed after deformation, and will only stretch out when the brush 12 is rotating.

In comparison with conventional devices comprising hard brushes for contacting a surface to be cleaned, the brush 12 which is used according to the present invention is capable of realizing cleaning results which are significantly better, due to the working principle according to which brush elements 16 are used for picking up liquid 24 and dirt 22 and taking the liquid 24 and the dirt 22 away from the surface 20 to be cleaned, wherein the liquid 24 and the dirt 22 are flung away by the brush elements 16 before they contact the surface 20 again in a next round.

Figure 8:
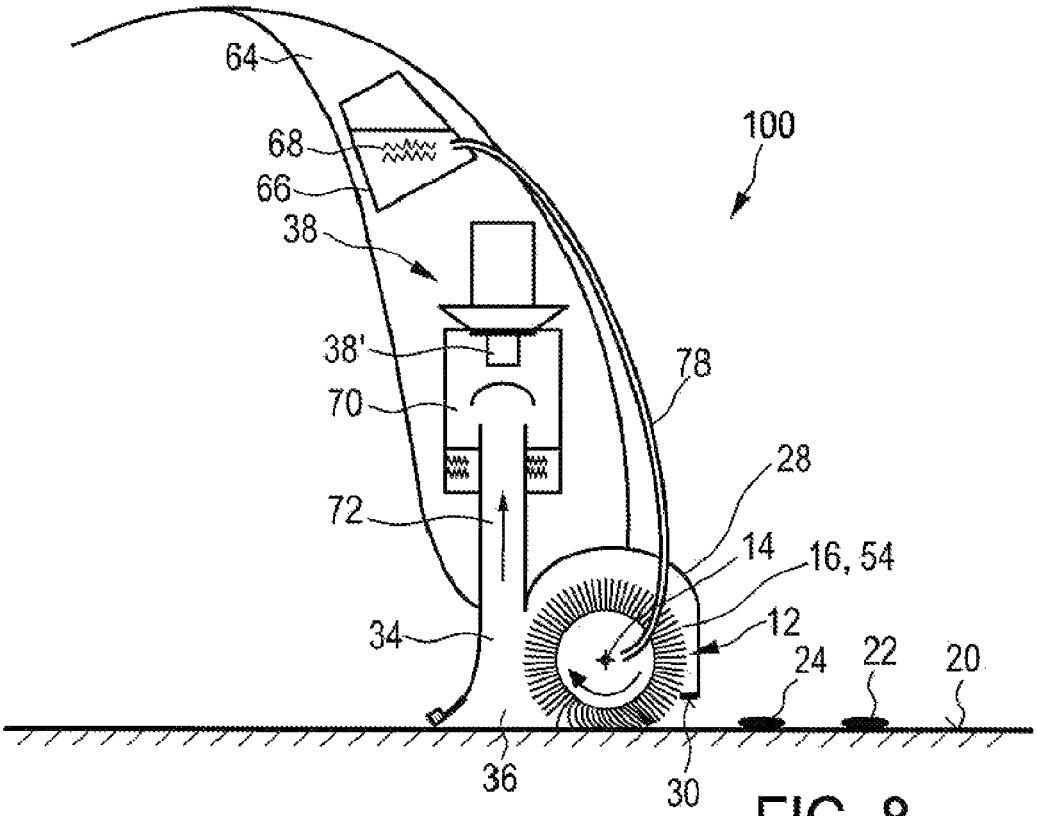
FIG. 8 shows a schematic cross-section of the cleaning device according to the present invention in its entirety.

FIG. 8 provides a view of the cleaning device 100 according to the present invention in its entirety. According to this schematic arrangement the cleaning device 100 comprises a nozzle housing 28 in which the brush 12 is rotatably mounted on the brush axis 14. A drive means, which can be realized be a regular motor, such as e.g. an electro motor (not shown), is preferably connected to or even located on the brush axis 14 for the purpose of driving the brush 12 in rotation. It is noted that the motor may also be located at any other suitable position within the cleaning device 100.

In the nozzle housing 28, means such as wheels (not shown) are arranged for keeping the rotation axis 14 of the brush 12 at a predetermined distance from the surface 20 to be cleaned, wherein the distance is chosen such that the brush 12 is indented. Preferably, the range of the indentation is from 2% to 12% of a diameter of the brush 12 relating to a fully outstretched condition of the brush elements 16. Hence, when the diameter is in an order of 50 mm, the range of the indentation can be from 1 to 6 mm.

As already explained above, the squeegee element 32 is spaced apart from the brush 12 and attached to the bottom side 30 of the nozzle housing 28. It extends substantially parallel to the brush axis 14, thereby defining a suction area 34 within the nozzle housing 28 in between the squeegee element 32 and the brush 12, which suction area 34 has a suction inlet 36 which is located at the bottom side 30 of the nozzle housing 28 facing the surface 20 to be cleaned.

Besides the nozzle housing 28, the brush 12 and the squeegee element 32, the cleaning device 100 is preferably provided with the following components:

- a handle 64 which allows for easy manipulation of the cleaning device 100 by a user;
- a reservoir 66 for containing a cleansing liquid 68 such as water;
- a debris collecting container 70 for receiving liquid 24 and dirt particles 22 picked up from the surface 20 to be cleaned;
- a flow channel in the form of, for example, a hollow tube 72, connecting the debris collecting container 70 to the suction area 34, which suction area 34 constitutes the suction inlet 36 on the bottom side 30 of the nozzle 10. It has to be noted that, in the meaning of the present invention, the flow channel including the hollow tube 72 may also be denoted as suction area 34 in which the above mentioned under-pressure is applied by the vacuum aggregate 38; and
- the vacuum fan aggregate 38 comprising a centrifugal fan 38', arranged at a side of the debris collecting chamber 70 which is opposite to the side where the tube 72 is arranged.

For sake of completeness, it is noted that within the scope of the present invention, other and/or additional constructional details are possible. For example, an element may be provided for deflecting the debris 22, 24 that is flung upwards, so that the debris 22, 24 first undergoes a deflection before it eventually reaches the debris collecting chamber 70. Also, the vacuum fan aggregate 38 may be arranged at another side of the debris collecting chamber 70 than the side which is opposite to the side where the tube 72 is arranged.

According to an embodiment, which is shown in FIG. 9, the brush 12 comprises a core element 52. This core element 52 is in the form of a hollow tube provided with a number of channels 74 extending through a wall 76 of the core element 52. For the purpose of transporting cleansing fluid 68 from the reservoir 66 to the inside of the hollow core element 52 of the brush 12, e.g. a flexible tube 78 may be provided that leads into the inside of the core element 52.

According to this embodiment cleansing fluid 68 may be supplied to the hollow core element 52, wherein, during the rotation of the brush 12, the liquid 68 leaves the hollow core element 52 via the channels 74, and wets the brush elements 16. In this way the liquid 68 also drizzles or falls on the surface 20 to be cleaned. Thus, the surface 20 to be cleaned becomes wet with the cleansing liquid 68. This especially enhances the adherence of the dirt particles 22 to the brush elements 16 and, therefore improves the ability to remove stains from the surface 20 to be cleaned.

According to the present invention, the rate at which the liquid 68 is supplied to the hollow core element 52 can be quite low, wherein a maximum rate can be 6 ml per minute per cm of the width of the brush 12, for example.

However, it is to be noted that the feature of actively supplying water 68 to the surface 20 to be cleaned using hollow channels 74 within the brush 12 is not a necessary feature. Alternatively, a cleansing liquid could be supplied by spraying the brush 12 from outside or by simply immersing the brush 12 in cleansing water before the use. Instead of using an intentionally chosen liquid, it is also possible to use a liquid that has been already spilled, i.e. a liquid that needs to be removed from the surface 20 to be cleaned.

The pick-up of the cleansing water 68 from the floor is, as already mentioned above, either done by the squeegee element 32 which collects the water by acting as a kind of wiper transporting liquid to the suction area 34 where it is ingested due to the under-pressure generated by the vacuum aggregate 38, or the water is directly picked-up from the floor by the brush 12. In comparison with conventional devices comprising hard brushes that are not able to pick-up water, the brush 12 used according to the present invention is capable of picking-up water. The realized cleaning results are thus significantly better.

The above-mentioned technical parameters regarding the brush 12, the brush elements 16 and the drive means result from experiments which have been performed in the context of the present invention.

In the following, one of the experiments and the results of the experiment will be described. The tested brushes were equipped with different types of fiber materials used for the brush elements 16, including relatively thick fibers and relatively thin fibers. Furthermore, the packing density as well as the Dtex values have been varied. The particulars of the various brushes are given in the following table.

| | packing density (# tufts/ $cm^2$) | fibers per tuft | Dtex value (g/10 km) | fiber material | fiber length (mm) | fiber appearance |
|---|---|---|---|---|---|---|
| brush 1 | 160 | 9 | 113.5 | nylon | 10 | springy, straight |
| brush 2 | 25 | 35 | 31.0 | nylon | 11 | fairly hard, curled |
| brush 3 | 40 | 90 | 16.1 | — | 11 | very soft, twined |
| brush 4 | 50 | 798 | 0.8 | polyester | 11 | very soft, twined |

The experiment includes rotating the brush under similar conditions and assessing cleaning results, wear, and power to the surface 20 subjected to treatment with the brush 12. This provides an indication of heat generation on the surface 20. The outcome of the experiment is reflected in the following table, wherein a mark 5 is used for indicating the best results, and lower marks are used for indicating poorer results.

| | stain removal | water pick-up | wear | power to the surface |
|---|---|---|---|---|
| Brush 1 | 5 | 3 | 3 | 3 |
| Brush 2 | 5 | 3 | 1 | 4 |
| Brush 3 | 5 | 4 | 4 | 5 |
| Brush 4 | 5 | 5 | 5 | 5 |

Among other things, the experiment proves that it is possible to have brush elements 16 with a linear mass density in a range of 100 to 150 g per 10 km, and to obtain useful cleaning results, although it appears that the water pick-up, the wear behavior and the power consumption are not so good. It is concluded that an appropriate limit value for the linear mass density is 150 g per 10 km. However, it is clear that with a much lower linear mass density, the cleaning results and all other results are very good. Furthermore, the above-mentioned sealing effect increases with a decrease of the Dtex value. Therefore, it is preferred to apply lower limit values, such as 125 g per 10 km, 50 g per 10 km, 20 g per 10 km, or even 5 g per 10 km. With values in the latter order, it is ensured that cleaning results are excellent, water pick-up is optimal, wear is minimal, and power consumption and heat generation on the surface 20 are sufficiently low.

It is noted that the minimum value of 3,000 $m/sec^2$ in respect of the acceleration which is prevailing at tips 18 of the brush elements 16 during some time per revolution of the brush 12, in particular some time during a dirt release period, in which there is no contact between the brush elements 16 and the surface 20, is supported by results of experiments which have been performed in the context of the present invention.

In the following, one of the experiments and the results of the experiment will be described. The following conditions are applicable to the experiment:

1) A brush 12 having a diameter of 46 mm, a width of approximately 12 cm, and polyester brush elements 16 with a linear mass density of about 0.8 g per 10 km, arranged in tufts 54 of about 800 brush elements 16, with approximately 50 tufts 54 per $cm^2$, is mounted on a motor shaft.

2) The weight of the assembly of the brush 12 and the motor is determined.

3) The power supply of the motor is connected to a timer for stopping the motor after a period of operation of 1 second or a period of operation of 4 seconds.

4) The brush 12 is immersed in water, so that the brush 12 is completely saturated with the water. It is noted that the brush 12 which is used appears to be capable of absorbing a total weight of water of approximately 70 g.

5) The brush 12 is rotated at an angular velocity of 1,950 revolutions per minute, and is stopped after 1 second or 4 seconds.

6) The weight of the assembly of the brush 12 and the motor is determined, and the difference with respect to the dry weight, which is determined under step 2), is calculated.

7) Steps 4) to 6) are repeated for other values of the angular velocity, in particular the values as indicated in the following table, which further contains values of the weight of the water still present in the brush 12 at the stops after 1 second and 4 seconds, and values of the associated centrifugal acceleration, which can be calculated according to the following equation:

$$a=(2*\pi*f)^2*R$$

in which:

a=centrifugal acceleration ($m/s^2$)

f=brush frequency (Hz)

R=radius of the brush 12 (m)

| angular velocity (rpm) | weight of water present after 1 s (g) | weight of water present after 4 s (g) | centrifugal acceleration ($m/s^2$) |
|---|---|---|---|
| 1,950 | 8.27 | 7.50 | 959 |
| 2,480 | 5.70 | 4.57 | 1,551 |
| 3,080 | 3.70 | 3.11 | 2,393 |
| 4,280 | 2.52 | 1.97 | 4,620 |
| 5,540 | 1.95 | 1.35 | 7,741 |
| 6,830 | 1.72 | 1.14 | 11,765 |
| 7,910 | 1.48 | 1.00 | 15,780 |
| 9,140 | 1.34 | 0.94 | 21,069 |

Figure 10:
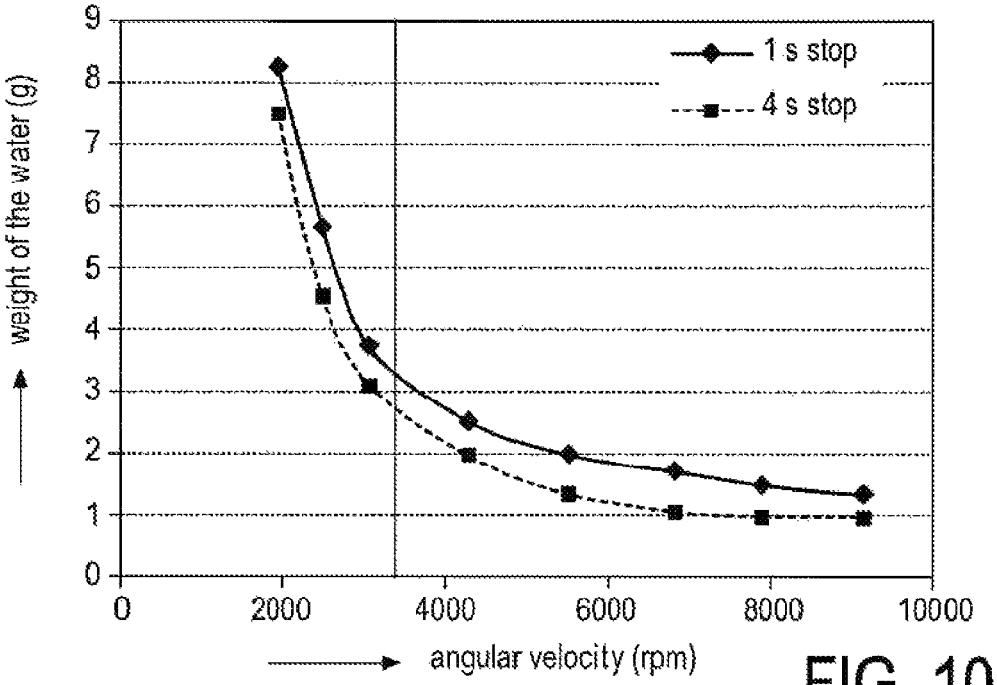
FIG. 10 shows a graph which serves for illustrating a relation between an angular velocity of a brush and a self-cleaning capacity of said brush.
Figure 11:
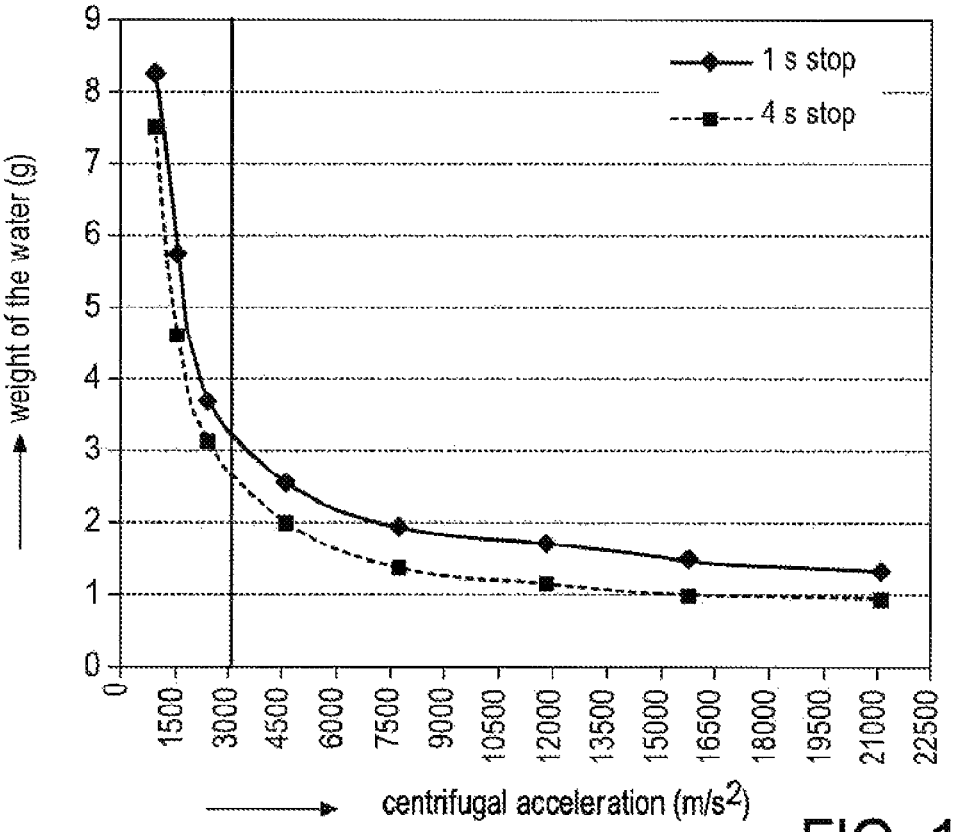
FIG. 11 shows a graph which serves for illustrating a relation between a centrifugal acceleration of a brush and a self-cleaning capacity of said brush.

The relation which is found between the angular velocity and the weight of the water for the two different stops is depicted in the graph of FIG. 10, and the relation which is found between the centrifugal acceleration and the weight of the water for the two different stops is depicted in the graph of FIG. 11, wherein the weight of the water is indicated at the vertical axis of each of the graphs. It appears from the graph of FIG. 10 that the release of water by the brush 12 strongly decreases, when the angular velocity is lower than about 4,000 rpm. Also, it seems to be rather stable at angular velocities which are higher than 6,000 rpm to 7,000 rpm.

A transition in the release of water by the brush 12 can be found at an angular velocity of 3,500 rpm, which corresponds to a centrifugal acceleration of 3,090 $m/s^2$. For sake of illustration of this fact, the graphs of FIGS. 10 and 11 contain a vertical line indicating the values of 3,500 rpm and 3,090 $m/s^2$, respectively.

On the basis of the results of the experiment as explained in the foregoing, it may be concluded that a value of 3,000 $m/s^2$ in respect of an acceleration at tips 18 of the brush elements 16 during a contact-free period is a realistic minimum value as far as the self-cleaning capacity of brush elements 16 which meet the requirement of having a linear mass density which is lower than 150 g per 10 km, at least at tip portions 18, is concerned. A proper performance of the self-cleaning function is important for obtaining good cleaning results, as has already been explained in the foregoing.

For sake of completeness, it is noted that in the cleaning device 100 according to the present invention, the centrifugal acceleration may be lower than 3,000 $m/s^2$. The reason is that the acceleration which occurs at tips 18 of the brush elements 16 when the brush elements 16 are straightened out can be expected to be higher than the normal centrifugal acceleration. The experiment shows that a minimum value of 3,000 $m/s^2$ is valid in respect of an acceleration, which is the normal, centrifugal acceleration in the case of the experiment, and which can be the higher acceleration which is caused by the specific behavior of the brush elements 16 when the dirt pick-up period has passed and there is room for straightening out in an actual cleaning device 100 according to the present invention, which leaves a possibility for the normal, centrifugal acceleration during the other periods of the rotation (e.g. the dirt pick-up period) to be lower.

Even though a single brush is, according to the present invention, preferred, it is clear that also further brushes may be used without leaving the scope of the present invention.

It will be clear to a person skilled in the art that the scope of the present invention is not limited to the examples discussed in the foregoing, but that several amendments and modifications thereof are possible without deviating from the scope of the present invention as defined in the attached claims. While the present invention has been illustrated and described in detail in the figures and the description, such illustration and description are to be considered illustrative or exemplary only, and not restrictive. The present invention is not limited to the disclosed embodiments.

For sake of clarity, it is noted that a fully outstretched condition of the brush elements 16 is a condition in which the brush elements 16 are fully extending in a radial direction with respect to a rotation axis 14 of the brush 12, wherein there is no bent tip portion in the brush elements 16. This condition can be realized when the brush 12 is rotating at a normal operative speed, which is a speed at which the acceleration of 3,000 $m/sec^2$ at the tips 18 of the brush elements 16 can be realized. It is possible for only a portion of the brush elements 16 of a brush 12 to be in the fully outstretched condition, while another portion is not, due to obstructions which are encountered by the brush elements 16. Normally, the diameter D of the brush 12 is determined with all of the brush elements 16 in the fully outstretched condition.

The tip portions 18 of the brush elements 16 are outer portions of the brush elements 16 as seen in the radial direction, i.e. portions which are the most remote from the rotation axis 14. In particular, the tip portions 18 are the portions which are used for picking up dirt particles 22 and liquid, and which are made to slide along the surface 20 to be cleaned. In case the brush 12 is indented with respect to the surface 20, a length of the tip portion is approximately the same as the indentation.

Further, it is to be noted that the contact between the brush 12 and the surface 20 may either be a line contact or an area contact. The second position 35 may thus either be a distinctive point, a line or an area.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A cleaning device for cleaning dirt particles and liquid from a surface, said cleaning device comprising:

a brush rotatably mounted in a nozzle housing for rotation about an axis and comprising a multiplicity of radially-extending flexible brush elements uniformly distributed over a circumferential periphery of the brush, said nozzle housing at least partly surrounding the brush and including an opening at a bottom side that, during use of the cleaning device, faces the surface to be cleaned, said opening being defined by first and second axially extending end portions nozzle housing arranged such that, during rotation of the brush:

the first axially-extending and portion is located sufficiently close to ends of the brush elements leaving the nozzle to continuously form a seal therewith, but access of said brush elements to the dirt particles and liquid on said surface to be cleaned being unobstructed when the nozzle is moved in a direction in which the second axially-extending end follows the first axially-extending end; and the second axially-extending end portion is spaced apart from brush elements re-entering the nozzle housing after contacting the surface to be cleaned, said spacing of the second axially-extending end portion from the re-entering brush elements defining a suction area for vacuuming the dirt particles and liquid from the surface to be cleaned;

a single wiper strip attached along the second axially-extending end portion of the nozzle housing and extending to the surface to be cleaned, said wiper strip being adapted to move dirt particles and liquid along the surface to be cleaned during movement of the cleaning device and defining, in a region between the single wiper strip and the brush elements, a suction inlet in communication with the suction area;

a drive apparatus for rotating the brush; and a vacuum apparatus for coupling to a suction outlet in communication with the suction area for generating an under-pressure in said suction area.

2. A cleaning device as claimed in claim 1 where said under-pressure generated by the vacuum apparatus is in a range of 3 to 70 mbar.

3. A cleaning device as claimed in claim 1 where the housing and the wiper strip extend along a longitudinal direction that is approximately parallel to the brush axis and transverse to the intended direction of movement of the cleaning device.

4. A cleaning device as claimed in claim 1 wherein said wiper strip comprises a switching member for switching the wiper strip to a closed position in which the wiper strip is adapted to move dirt particles and liquid along the surface to be cleaned, when the cleaning device is moved on the surface in a first direction in which the wiper strip travels behind the brush, and for switching the wiper strip to an open position in which dirt particles and liquid from the surface can enter the suction area through a at least one opening between the wiper strip and the surface to be cleaned, when the cleaning device is moved on the surface in a second direction in which the wiper strip travels in front of the brush.

5. A cleaning device as claimed in claim 1 and comprising a restriction element arranged in the suction area for at least partly restricting a suction effect between the suction inlet and the suction outlet.

6. A cleaning device as claimed in claim 5 where said restriction element comprises a housing part that decreases the distance between the housing and the brush at a position in the suction area between the suction inlet and the suction outlet.

7. A cleaning device as claimed in claim 5 where said restriction element comprises a housing part that contacts the brush at a position in the suction area between the suction inlet and the suction outlet.

8. A cleaning device as claimed in claim 1 where the drive apparatus is adapted to effect production of a centrifugal acceleration at tip portions of the brush elements of at least 3,000 $m/s^2$ during a dirt release period when the brush elements are free from contact with the surface during rotation of the brush.

9. A cleaning device as claimed in claim 1 wherein a linear mass density of a plurality of the brush elements is, at least at tip portions of the brush elements, lower than 150 g per 10 km.

10. A cleaning device as claimed in claim 1 and comprising positioning means for positioning the axis at a distance from the surface to be cleaned that is smaller than the radius of the brush with fully outstretched brush elements to achieve an indentation of the brush part contacting the surface during operation in a range from 2% to 12% of the brush diameter.

11. A cleaning device as claimed in claim 1 where a packing density of the brush elements is at least 30 tufts of brush elements per $cm^2$ and where a number of brush elements per tuft is at least 500.

12. A cleaning device as claimed in claim 1 where the drive apparatus is adapted to effect production of a rotary speed of the brush in a range of 3,000 to 15,000 revolutions per minute during operation of the cleaning device.

13. A cleaning device as claimed in claim 1 where the brush has a diameter in a range of 10 to 100 mm, when the brush elements are in a fully outstretched condition, and where a length of the brush elements is in a range of 1 to 20 mm, when the brush elements are in a fully outstretched condition.

14. A cleaning device as claimed in claim 1, and comprising apparatus for supplying a liquid to the brush at a rate which is lower than 6 ml per minute per cm of a width of the brush in which the brush axis extends.

15. A cleaning device as claimed in claim 1 where said under-pressure generated by the vacuum apparatus is in a range of 4 to 50 mbar.

16. A cleaning device as claimed in claim 1 where said under-pressure generated by the vacuum apparatus is in a range of 5 to 30 mbar.

17. A cleaning device as claimed in claim 1 where a linear mass density of a plurality of the brush elements is, at least at tip portions of the brush elements, preferably lower than 20 g per 10 km.

18. A cleaning device as claimed in claim 1 where the drive apparatus is adapted to effect production of an angular velocity of at least tips of the brush in a range of 5,000 to 8,000 revolutions per minute during operation of the cleaning device.

19. A cleaning device as claimed in claim 1 where the brush has a diameter in a range of 20 to 80 mm, when the brush elements are in a fully outstretched condition, and where a length of the brush elements is in a range of 8 to 12 mm, when the brush elements are in a fully outstretched condition.

20. A cleaning device as claimed in claim 1 where the brush has a diameter in a range of 35 to 50 mm, when the brush elements are in a fully outstretched condition, and where a length of the brush elements is in a range of 8 to 12 mm, when the brush elements are in a fully outstretched condition.

21. A nozzle arrangement for a cleaning device for cleaning dirt particles and liquid from a surface, said nozzle arrangement comprising:

a brush rotatably mounted in a nozzle housing for rotation about an axis and comprising a multiplicity of radially-extending flexible brush elements uniformly distributed over a circumferential periphery of the brush, said nozzle housing at least partly surrounding the brush and including an opening at a bottom side that, during use of the cleaning device, faces the surface to be cleaned, said opening being defined by first and second axially extending end porions of the nozzle housing arranged such that, during rotation of the brush:

the first axially-extending end portion is located sufficiently close to ends of the brush elements leaving the nozzle to continuously form a seal therewith, but access of said brush elements to the dirt particles and liquid on said surface to be cleaned being unobstructed when the nozzle is moved in a direction in which the second axially-extending end follows the first axially-extending end; and the second axially-extending end portion is spaced apart from brush elements re-entering the nozzle housing after contacting the surface to be cleaned, said spacing of the second axially-extending end portion from the re-entering brush elements defining a suction area for vacuuming the dirt particles and liquid from the surface to be cleaned;

a single wiper strip attached along the second axially-extending end portion nozzle housing and extending to the surface to be cleaned, said wiper strip being adapted to move dirt particles and liquid along the surface to be cleaned during movement of the cleaning device and defining, in a region between the wiper strip and the brush elements, a suction inlet in communication with the suction area.

* * * * *